US005389730A

United States Patent [19]

Wachi

[11] Patent Number: 5,389,730

[45] Date of Patent: Feb. 14, 1995

[54] EMPHASIZE SYSTEM FOR ELECTRONIC MUSICAL INSTRUMENT

[75] Inventor: Masatada Wachi, Hamamatsu, Japan

[73] Assignee: Yamaha Corporation, Hamamatsu, Japan

[21] Appl. No.: 674,558

[22] Filed: Mar. 20, 1991

[30] Foreign Application Priority Data

Mar. 20, 1990 [JP] Japan ..... 2-70501
Mar. 20, 1990 [JP] Japan ..... 2-70502

[51] Int. Cl.[6] ..... G10H 1/02

[52] U.S. Cl. ..... 84/624; 84/625; 84/626; 84/660; 84/661; 84/673; 84/700; 84/736; 84/DIG. 9

[58] Field of Search ..... 84/603–607, 84/622, 624–626, 658, 659–661, 673, 699, 700, 735, 736, 741, DIG. 9; 381/94, 98, 103, 106, 110

[56] References Cited

U.S. PATENT DOCUMENTS

| | | | |
|---|---|---|---|
| 3,818,149 | 6/1974 | Stearns et al. | 381/98 X |
| 3,911,776 | 10/1975 | Beigel | 84/DIG. 9 |
| 4,265,157 | 5/1981 | Fricke et al. | 84/695 |
| 4,276,802 | 7/1981 | Mieda | 84/700 |
| 4,316,060 | 2/1982 | Adams et al. | 381/98 |
| 4,316,401 | 2/1982 | Tavel et al. | 84/DIG. 8 |
| 4,354,160 | 10/1982 | Pierce | 381/103 X |
| 4,357,852 | 11/1982 | Suenaga | 84/454 X |
| 4,432,097 | 2/1984 | Okada et al. | 381/98 |
| 4,532,849 | 8/1985 | Drew | 381/51 X |
| 4,638,258 | 1/1987 | Crooks | 330/149 |
| 4,655,115 | 4/1987 | Nishimoto | 84/DIG. 10 |
| 4,698,842 | 10/1987 | Mackie et al. | 381/1 |
| 4,736,434 | 4/1988 | Filliman | 381/106 |
| 4,738,179 | 4/1988 | Suzuki | 84/DIG. 9 X |
| 4,757,737 | 7/1988 | Conti | 84/681 |
| 4,809,338 | 2/1989 | House | 381/103 |
| 4,851,142 | 3/1989 | Imreh | 381/106 |
| 4,915,001 | 4/1990 | Dillard | 84/600 |
| 4,972,753 | 11/1990 | Adachi et al. | 84/626 |
| 4,998,281 | 3/1991 | Sakata | 381/63 |
| 5,050,217 | 9/1991 | Orban | 381/98 X |
| 5,094,138 | 3/1992 | Otsuka et al. | 84/663 |
| 5,095,539 | 3/1992 | Leveque | 381/106 X |

FOREIGN PATENT DOCUMENTS

| | | |
|---|---|---|
| 403589 | 2/1940 | Japan . |
| 46-35590 | 10/1971 | Japan . |

*Primary Examiner*—Jonathan Wysocki
*Assistant Examiner*—Brian Sircus
*Attorney, Agent, or Firm*—Spensley Horn Jubas & Lubitz

[57] ABSTRACT

An emphasize system for an electronic musical instrument including filter and control device. The filter extract and output predetermined frequency range component of an input musical tone signal. The control device control the level of an output from the filter at least on the basis of an output from an envelope generator which controls the level of the input musical tone signal, or on the basis of the level of another frequency range component of the input musical tone signal. At least the level controlled signal is outputted from the system.

61 Claims, 16 Drawing Sheets

EMPHASIZE SYSTEM FOR ELECTRONIC MUSICAL INSTRUMENT

BACKGROUND OF THE INVENTION

1. Field of the Invention

The present invention relates to an emphasize system for an electronic musical instrument and, more particularly, to an emphasize system which emphasizes a predetermined frequency range component of a musical tone.

2. Description of the Prior Art

As an electronic musical instrument which controls the output level of a predetermined frequency range component of a musical tone in accordance-with a tone volume, the following apparatus is known. That is, an instrument generates a waveform signal having a large number of harmonic components in a sound source circuit, and when this signal is filtered through a filter circuit to cut unnecessary harmonic components, a filter constant is changed in accordance with a musical tone level outputted from the sound source circuit, thereby controlling a harmonic component ratio (Japanese Patent Publication No. Sho 40-3589).

In another known apparatus, a tone volume level of a musical tone signal to be generated is detected, and characteristics of a tone color filter are changed on the basis of the detected level, thereby controlling a harmonic overtone component ratio in a musical tone signal (Japanese Patent Publication No. Sho 46-35590).

However, since either of the prior arts described above simply changes frequency characteristics of, e.g., a filter in accordance with a tone volume level of a musical tone, delicate and colorful changes in tone colors cannot be satisfactorily provided.

For example, when a musical tone having spectrum components concentrated in a low-frequency range is inputted, a conventional system undesirably amplifies a frequency range (high-frequency range) having no harmonic overtone components, resulting in a low S/N ratio.

SUMMARY OF THE INVENTION

The present invention has been made in consideration of the conventional drawbacks, and has as its object to provide an emphasize system for an electronic musical instrument, which apparatus can output a musical tone signal having sound quality in which the existence of a musical tone in a specific sound region, e.g., a solo part is delicately and colorfully emphasized in accordance with a tone volume of an input musical tone signal or a touch level without impairing an S/N ratio, and is stressed in a music piece.

In order to achieve the above object, an emphasize system for an electronic musical instrument according to the present invention comprises a filter for allowing a predetermined frequency range component to be emphasized of an input musical tone signal to pass therethrough, multiplier means for multiplying a signal of the predetermined frequency range component passing through the filter, and a signal on the basis of an output from an envelope generator of the electronic musical instrument, and outputting a product signal, and mixing means for mixing an output from the multiplier means and an input musical tone signal or a signal obtained by modifying the input musical tone signal, and outputting a mixed signal.

The basic location of this emphasize system is as shown in, e.g., FIGS. 2*a* to 2*c*. More specifically, as shown in FIGS. 2*a* to 2*c*, a musical tone designation data generator 22 generates musical tone designation data on the basis of operations of various operation members 21 such as switches, a keyboard, and the like, and a musical tone waveform generator 23 generates a musical tone waveform signal on the basis of the generated data. At the same time, an envelope generator 24 generates an envelope signal (to be referred to as an EG signal hereinafter). In FIG. 2*a*, an envelope is given to a musical tone waveform signal by a multiplier means 25, and an emphasize system 26 of the present invention is applied to this signal. In FIG. 2*b*, the emphasize system of the present invention is applied to a musical tone waveform signal before an envelope is given, and an envelope is given to the effect-added (emphasized) musical tone waveform signal. In FIG. 2*c*, the emphasize system of the present invention simultaneously emphasizes and gives an envelope to a musical tone waveform signal. More specifically, a multiplier means for giving an EG signal is equivalently included in the emphasize system of the present invention.

In these circuits, a predetermined frequency range component to be emphasized of a musical tone waveform signal inputted to the emphasize system of the present invention or a musical tone signal obtained by giving an envelope to the input musical tone waveform signal is extracted by a filter, and a signal based on an EG signal is multiplied with the extracted component. Since the EG signal is a data signal which faithfully represents the level of a musical tone signal, the predetermined frequency range component to be emphasized is emphasized in accordance with the musical tone signal level upon multiplication. The predetermined frequency range component of an output from the mixing means is also emphasized in accordance with the musical tone signal level. Therefore, a signal based on the envelope generator and to be multiplied with a predetermined frequency range component to be emphasized is appropriately selected and set, so that an effect which cannot be attained by a conventional system can be given by a simple arrangement. For example, when accompaniment and solo parts have independent musical tone generation systems, a sole part tone is emphasized on the basis of an accompaniment tone envelope signal, thus always emphasizing the solo part.

An emphasize system (to be also referred to as an emphasizer hereinafter) for an electronic musical instrument according to another aspect of the present invention comprises first filter means for extracting and outputting a predetermined first frequency range component of an input musical tone signal, second filter means for extracting and outputting a second frequency range component of the input musical tone signal, level detection means for detecting and outputting an output signal level of the second filter means, multiplier means for multiplying a signal based on an output from the level detection means with an output signal from the first filter means, and outputting a product signal, and mixing means for mixing an output from the multiplier means with the input musical tone signal or a musical tone signal obtained by modifying the input musical tone signal, and outputting a mixed signal.

In this arrangement, the first and second filter means extract first and second frequency range components from a musical tone signal inputted from, e.g., a musical tone waveform generator of an electronic musical instrument. The first frequency range component is emphasized through the multiplier means in accordance with a signal based on a signal level of the second frequency range component detected by the level detection means. The input musical tone signal is mixed with the emphasized first frequency range component, and the mixed signal is outputted. More specifically, an output musical tone signal has the emphasized first frequency range component of the input musical tone signal in accordance with the level of the second frequency range component.

Therefore, when first and second frequency ranges are appropriately set, delicate and colorful output balance control in units of frequency ranges can be performed without impairing an S/N ratio due to unnecessary amplified components. More specifically, with this processing, a solo part in a high tone range is emphasized in accordance with a tone volume level of an accompaniment part in a middle tone range, thus outputting clear musical tone signals with the emphasized solo part without deteriorating original tone color balance of original tones.

Other features and advantages of the present invention will be apparent from the following description taken in conjunction with the accompanying drawings.

DETAILED DESCRIPTION OF THE PREFERRED EMBODIMENTS

The preferred embodiments of the present invention will be described hereinafter with reference to the accompanying drawings.

First Embodiment

Figure 1:
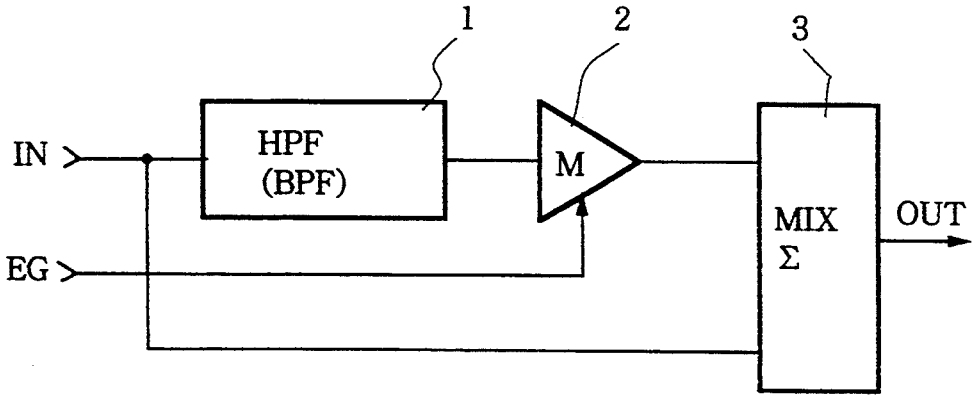
FIG. 1 is a block diagram showing an arrangement of an emphasizer according to the basic first embodiment of the present invention.
Figure 2A:
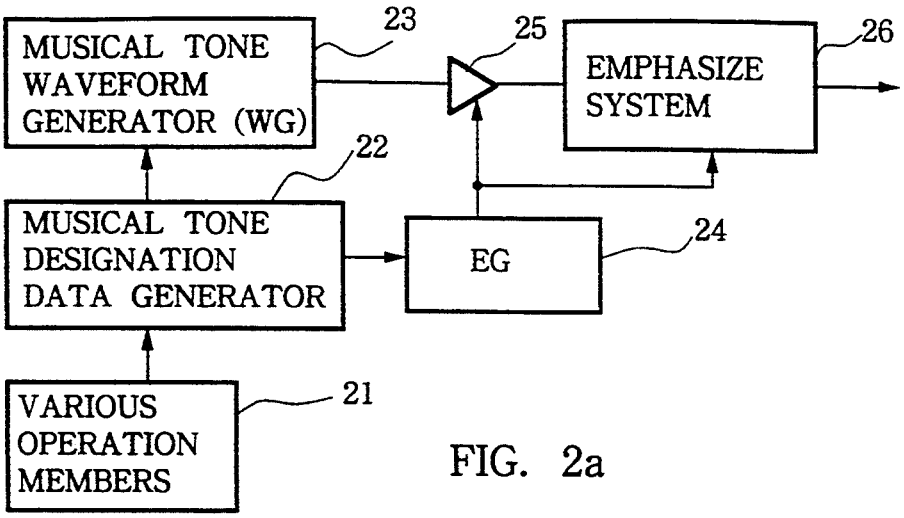
FIGS. 2*a* to 2*c* are block diagrams showing different locations of the emphasizer of the present invention in an electronic musical instrument.
Figure 2B:
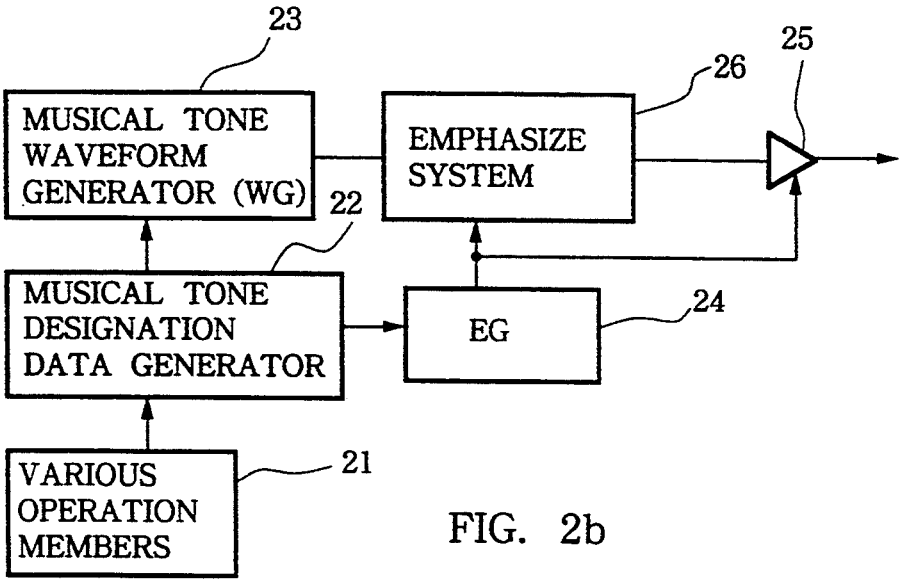
Figure 2C:
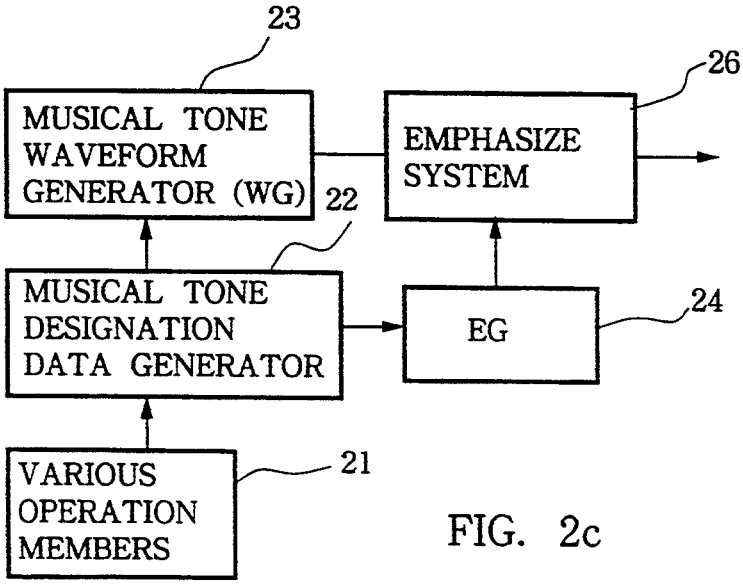

FIG. 1 is a block diagram showing an arrangement of an emphasizer according to the basic first embodiment of the present invention. In FIG. 1, reference numeral 1 denotes a high-pass filter for allowing a high-frequency range component to be emphasized in an input signal IN to pass therethrough, and outputting it; 2, a multiplier for multiplying an output from the high-pass filter 1 with an externally input EG signal, and outputting the product; and 3, a mixing circuit for mixing the input signal IN and an output from the multiplier 2 and outputting the mixed signal.

In this arrangement, when the input signal IN is inputted, the high-pass filter 1 allows only a high-frequency range component of the input signal IN to pass therethrough, and the EG signal (emphasis control signal M) is multiplied with the high-frequency range component by the multiplier 2. Thus, the high-frequency range component is emphasized in accordance with the level of the EG signal. The mixing circuit 3 mixes the emphasized signal and the input signal IN, thus outputting a signal OUT in which only the high-frequency range component of the input signal IN is emphasized in accordance with the signal level of the EG signal.

In FIG. 1, the EG signal is directly multiplied with the high-frequency range component as the emphasis control signal M. In this case, the EG signal may be multiplied with the high-frequency range component after it is desirably modified. FIGS. 3*a* to 3*d* show modifications of the EG signal.

Figure 3A:
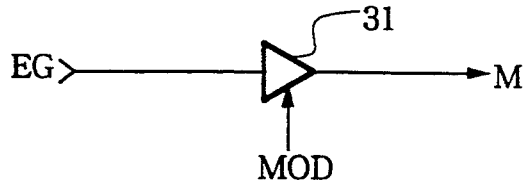
FIGS. 3*a* to 3*d* are circuit diagrams showing modifications of an EG signal performed in the emphasizer shown in FIG. 1.

FIG. 3*a* exemplifies a case wherein the emphasis control signal M is obtained by multiplying the EG signal with an appropriate coefficient MOD by a multiplier 31, and is supplied to the multiplier 2. The control signal MOD inputted to the multiplier 31 may be either a fixed value or a value changed over time.

Figure 3B:
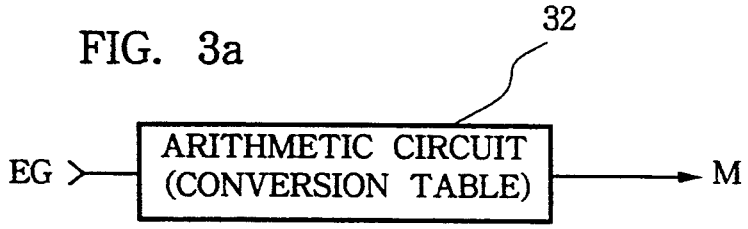

FIG. 3*b* exemplifies a case wherein an arithmetic circuit 32 performs a square arithmetic operation, a log conversion, or the like of the EG signal. The arithmetic circuit 32 may look up a conversion table.

Figure 3C:
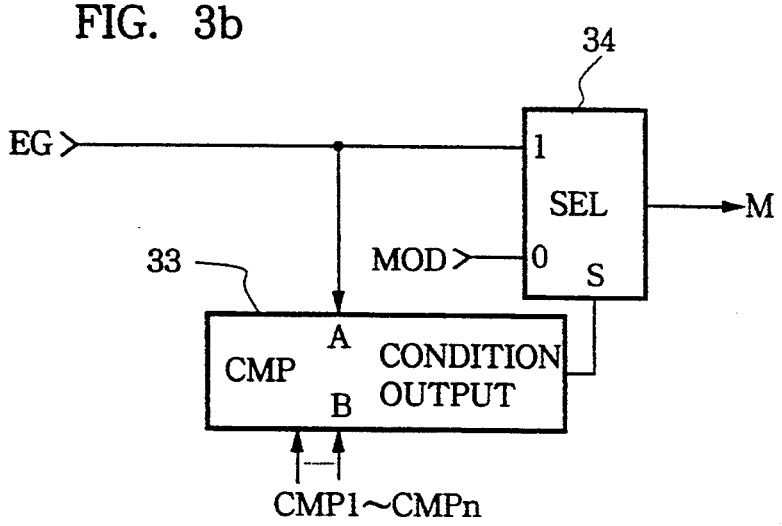

FIG. 3*c* exemplifies a case wherein the EG signal is compared with comparison condition signals CMP1 to COMPn by a comparator 33, and a selector 34 selects the EG signal and supplies it to the multiplier 2 when the EG signal satisfies a comparison condition (the relationship between their magnitudes, the intra-range relationship, or the like), or selects a predetermined signal MOD and supplies it to the multiplier 2 when the EG signal does not satisfy the comparison condition.

Figure 3D:
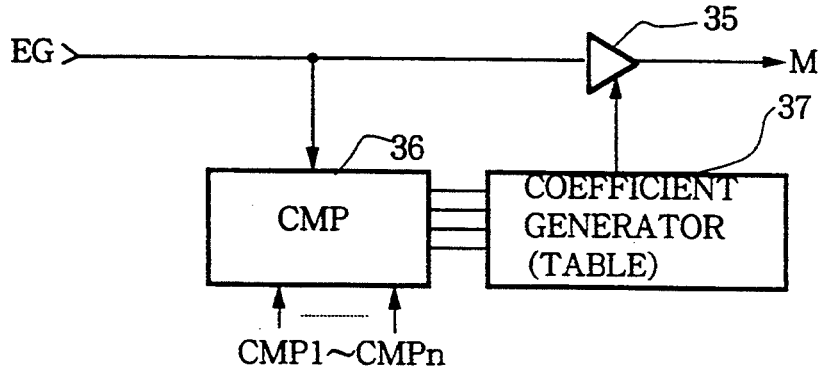

In FIG. 3*d*, the EG signal is supplied through a multiplier 35. A coefficient to be multiplied by the multiplier 35 is generated by a coefficient generator 37 in accordance with comparison results between the EG signal and comparison condition signals CMP1 to CMPn by a comparator 36. Note that a table may be accessed based on a signal value itself of the EG signal to read out a coefficient value.

Second Embodiment

Figure 4:
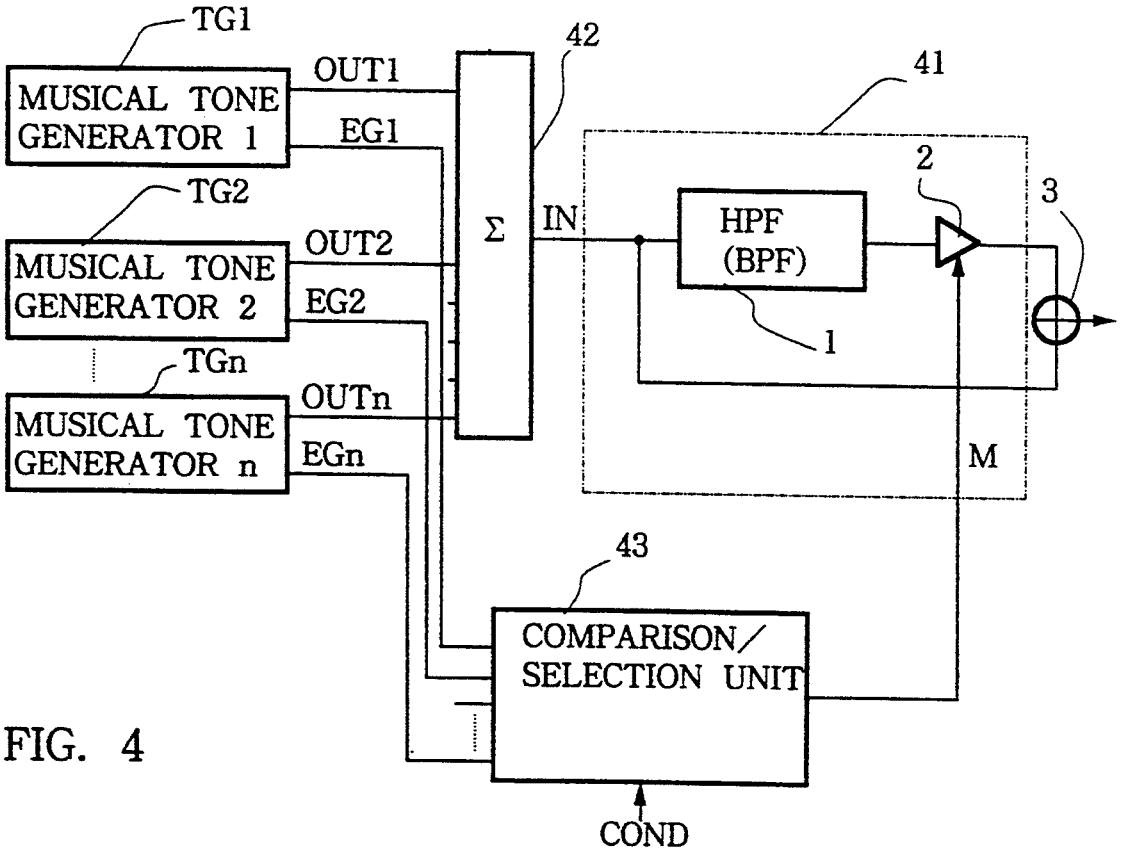
FIG. 4 is a block diagram showing the second embodiment of the present invention.

FIG. 4 is a block diagram showing the second embodiment of the present invention, and shows a use example of an emphasizer when an electronic musical instrument has a polyphonic arrangement, i.e., a plurality of musical tone generators TG1 to TGn. An emphasizer 41 has the same arrangement and the same operation as that shown in FIG. 1. In this case, outputs OUT1 to OUTn from the musical tone generators TG1 to TGn are mixed by a mixing circuit 42, and the mixed signal is inputted to a filter 1 of the emphasizer 41. EG signals EG1 to EGn generated by the musical tone generators TG1 to TGn are compared with a selection condition signal COND by a comparison/selection unit 43. Only an EG signal which satisfies the condition is selected by the comparison/selection unit as an emphasis control signal M, and is inputted to the emphasizer 41. As a typical emphasis control signal to be outputted from the comparison/selection unit 43, a maximum EG signal value obtained by comparing the EG signals EG1 to EGn calculating and then selecting may be used.

Figure 5:
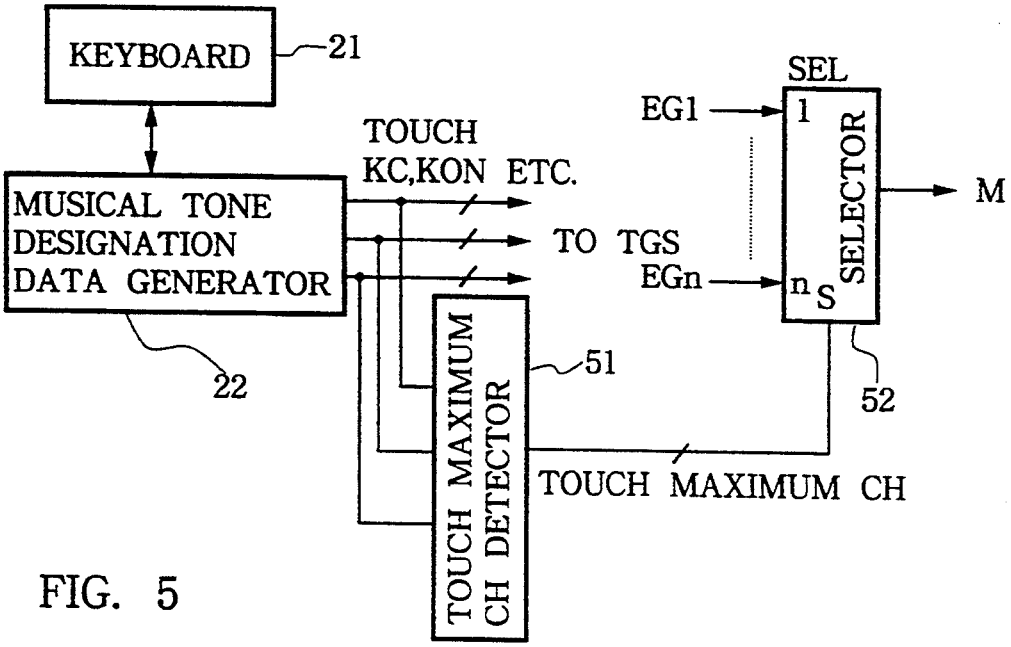
FIG. 5 is a detailed circuit diagram of a comparison/selection unit 43 of the emphasizer shown in FIG. 4.

FIG. 5 is a block diagram showing a simplest arrangement of the comparison/selection unit 43. In FIG. 5, reference numeral 51 denotes a detector for detecting a tone generation channel having maximum key touch data on the basis of a key touch signal TOUCH, a key ON signal KON, and the like supplied from a musical tone designation data generator 22, and outputting the detected channel data; and 52, a selector for selecting an EG signal corresponding to the detected tone generation channel from the EG signals EG1 to EGn, and outputting the selected signal as the emphasis control signal M. The detector 51 and the selector 52 constitute the comparison/selection unit.

When a plurality of keys are simultaneously depressed on a keyboard 21, the musical tone designation data generator 22 sends key code data KC, key ON data KON, key touch data TOUCH, and the like of the ON keys to the musical tone generators TG1 to TGn on the basis of the depressed keys. The musical tone generators TG1 to TGn generate musical tone waveforms, and add envelopes thereto on the basis of the input data. On the other hand, the detector 51 detects a tone generation channel having maximum ON key touch data based on the data of the ON keys from the musical tone designation data generator 22. The selector 52 selects only an EG signal corresponding to the detected tone generation channel from the EG signals EG1 to EGn inputted from the musical tone generators TG1 to TGn, and outputs the selected EG signal as the emphasis control signal M.

Third Embodiment

Figure 6:
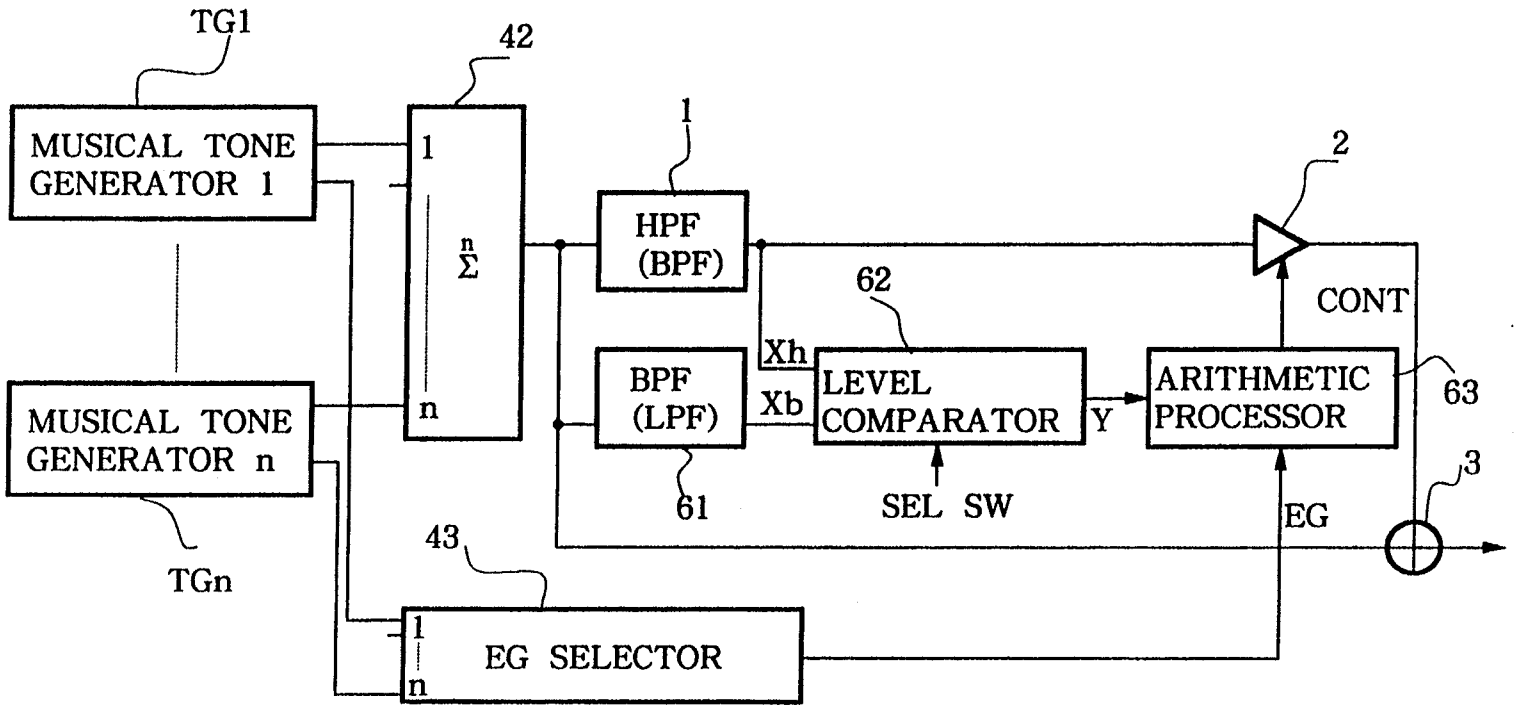
FIG. 6 is a block diagram showing the third embodiment of the present invention.

FIG. 6 is a block diagram according to the third embodiment of the present invention. In this embodiment, a band-pass filter 61 for extracting and outputting a middle-frequency range component from an input signal from a mixing circuit 42, a level comparator 62 for comparing outputs from a high-pass filter 1 and the band-pass filter 61, and outputting a signal Y as a comparison result, and an arithmetic processor 63 for performing predetermined arithmetic processing of an EG signal selected by a comparison/selection unit 43, and outputting the arithmetic processing result to a multiplier 2 are added to the embodiment shown in FIG. 4. Then, a final emphasis control signal CONT is generated on the basis of a comparison/arithmetic result of the levels of a high-frequency range component to be emphasized, which is outputted from the filter 1, and a middle-frequency range component outputted from the filter 61.

Figure 7:
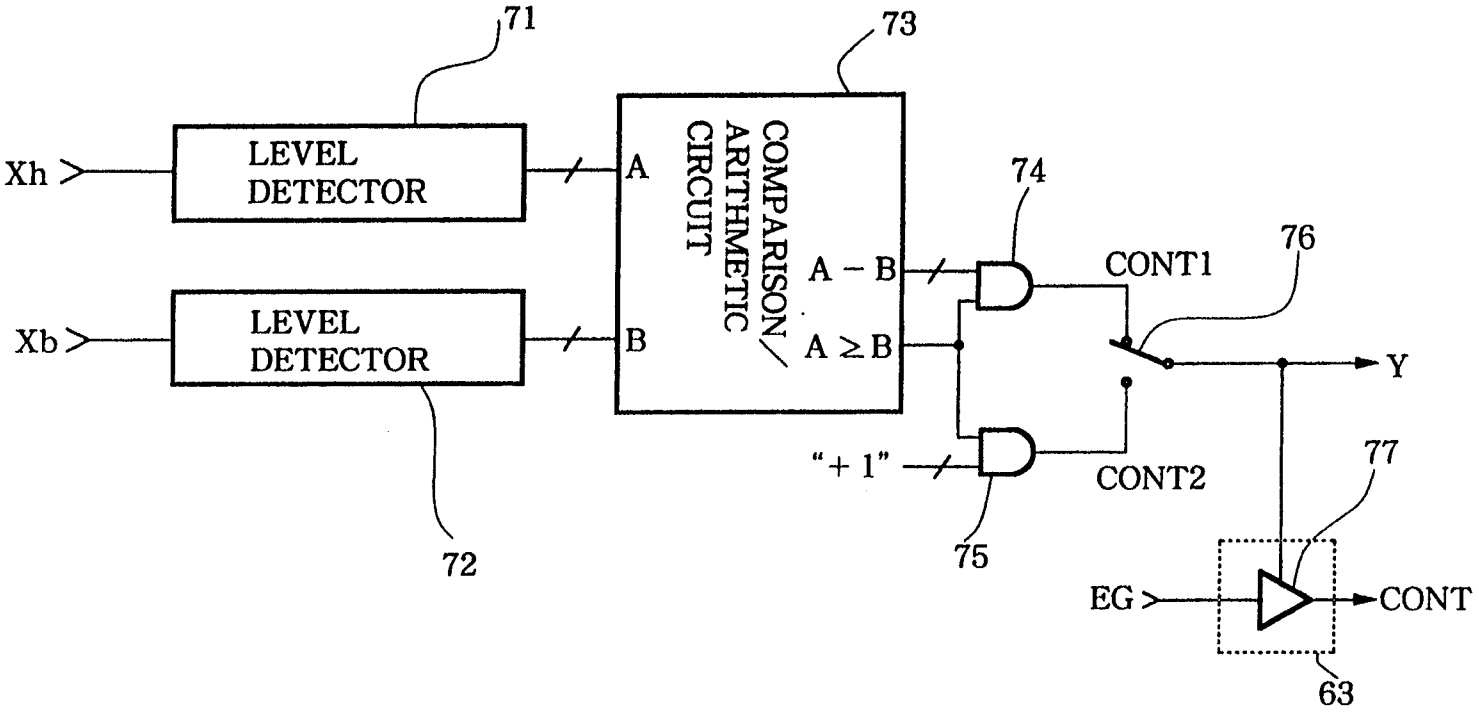
FIG. 7 is a detailed block diagram of a level comparator and an arithmetic processor in the emphasizer shown in FIG. 6.

FIG. 7 is a detailed circuit diagram of the portion of the level comparator 62 and the arithmetic processor 63. In FIG. 7, reference numerals 71 and 72 denote level detectors for respectively detecting and outputting the levels of an output $X_h$ from the high-pass filter I and an output $X_b$ from the band-pass filter 61; 73, a comparison/arithmetic circuit for comparing the outputs from the level detectors 71 and 72, and outputting a level difference between the two outputs, and "+1" or "0" in accordance with the relationship between their magnitudes; 74, an OR gate for calculating and outputting a logical sum of these comparison results; 75, an OR gate for calculating and outputting a logical sum of "+1" and an output indicating the relationship between the magnitudes of the two outputs and outputted from the comparison/arithmetic circuit 73; 76, a selection switch for selecting one of the outputs from the OR gates 74 and 75; and 77, a multiplier constituting the arithmetic processor 63.

The high-frequency range component $X_h$ and the middle-frequency range component $X_b$ are respectively level-detected by the level detectors 71 and 72, and a level difference between the two outputs and "+1" or "0" indicating the relationship between their magnitudes are outputted from the comparison/arithmetic circuit 73. In this case, "+1" is outputted when $X_h$ level $\geqq X_b$ level, and "0" is outputted when $X_h$ level $< X_b$ level. Therefore, when $X_h$ level $\geqq X_b$ level, if the OR gate 74 is selected, the signal Y represents a level difference between the two outputs; if the OR gate 75 is selected, the signal Y is "+1". When $X_h$ level $< X_b$ level, the signal Y becomes "0" in either selection. The emphasis control signal CONT is generated as a product ($Y \times EG$) of the signal Y and the EG signal by the multiplier 77. Therefore, only when $X_h$ level $\geqq X_b$ level, the high-frequency range component is emphasized. When the OR gate 74 is selected, a degree of emphasis is enhanced in accordance with a level difference, and a larger tone color change effect can be obtained.

In multiplication of the signal Y and the EG signal, a given constant a may be additionally multiplied, and the signal CONT may be given by $a \times Y \times EG$.

Fourth Embodiment

Figure 8:
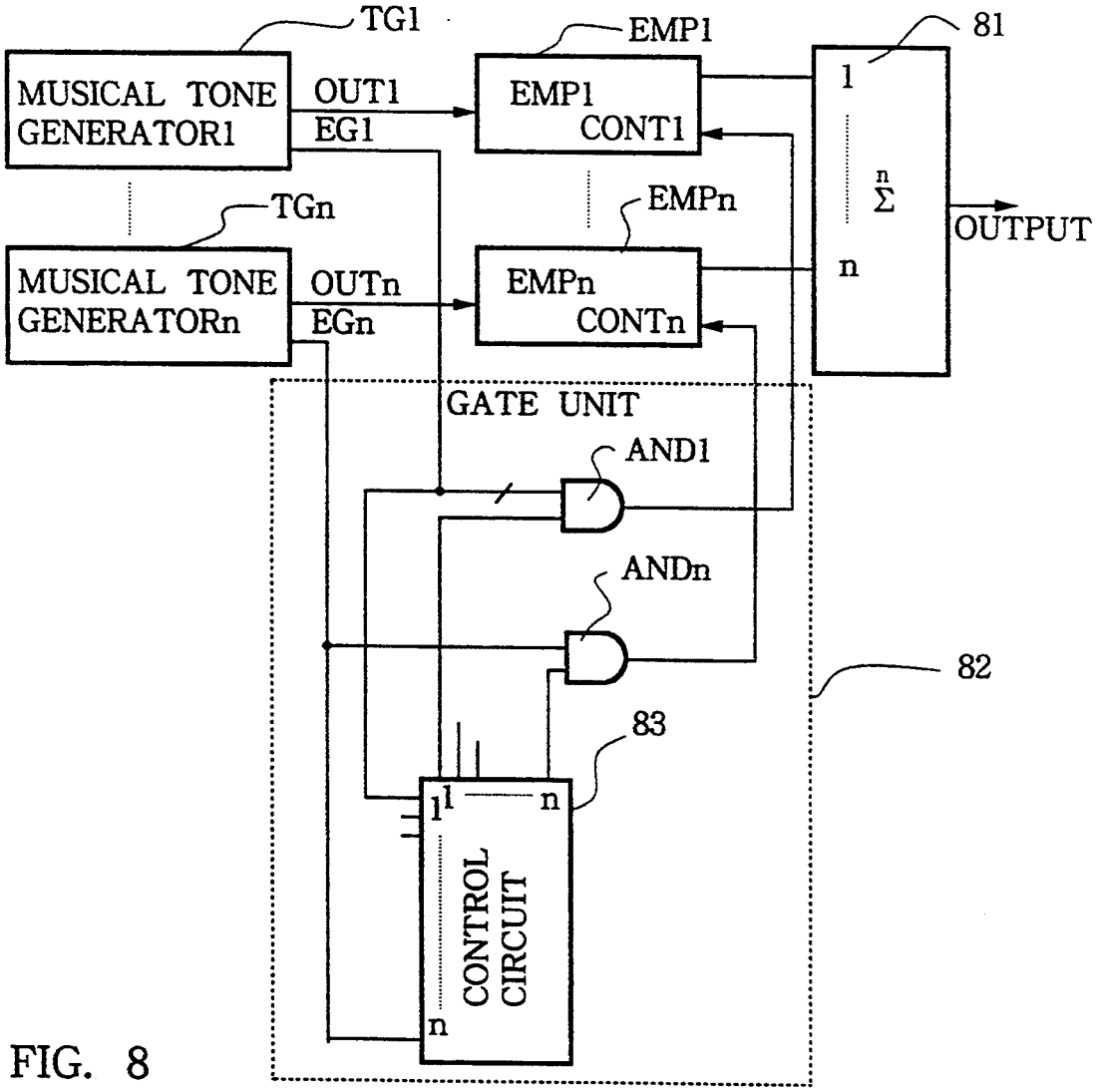
FIG. 8 is a block diagram showing the fourth embodiment of the present invention.

FIG. 8 is a block diagram according to the fourth embodiment of the present invention. In this embodiment, emphasizers are independently arranged in units of channels of a polyphonic system. Emphasizers EMP1 to EMPn described above are arranged in correspondence with the musical tone generators TG1 to TGn, and signals emphasized by these emphasizers are mixed by a mixing circuit 81, thus outputting a mixed signal. EG signals EG1 to EGn from the musical tone generators TG1 to TGn are supplied to the corresponding emphasizers EMP1 to EMPn via a controller 82. The controller 82 comprises a gate unit including AND gates AND1 to ANDn, and a gate control circuit 83, and enables only a gate corresponding to an EG signal having a maximum level to output the corresponding EG signal.

Figure 9:
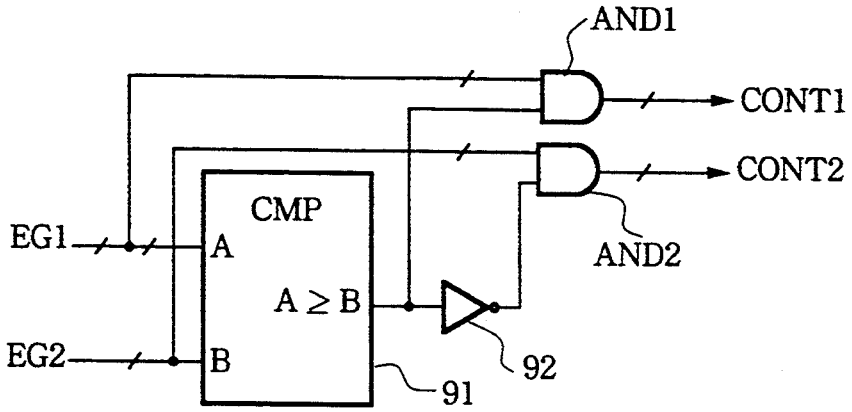
FIG. 9 is a circuit diagram showing an arrangement of a controller shown in FIG. 8 for two channels.

FIG. 9 is a block diagram showing an arrangement of the controller 82 for two channels. Reference numeral 91 denotes a comparator for comparing input EG signals EG1 and EG2, and for, when the signal EG1 level ≧the signal EG2 level, outputting "1"; otherwise, outputting "0"; and 92, an inverter for inverting and outputting an output from the comparator 91. An AND gate AND1 receives the EG signal EG1 and an output from the comparator 91, and an AND gate AND2 receives the EG signal EG2 and the output from the comparator 91, which output is inverted by the inverter 92.

When the signal EG1 level ≧the signal EG2 level, since the output from the comparator 91 is "1", the AND gate AND1 is enabled, and only the EG signal EG1 is outputted. On the contrary, when the signal EG1 level <the signal EG2 level, only the AND gate AND2 is enabled, and only the EG signal EG2 is outputted. More specifically, only a signal having a larger level is outputted.

Fifth Embodiment

Figure 10:
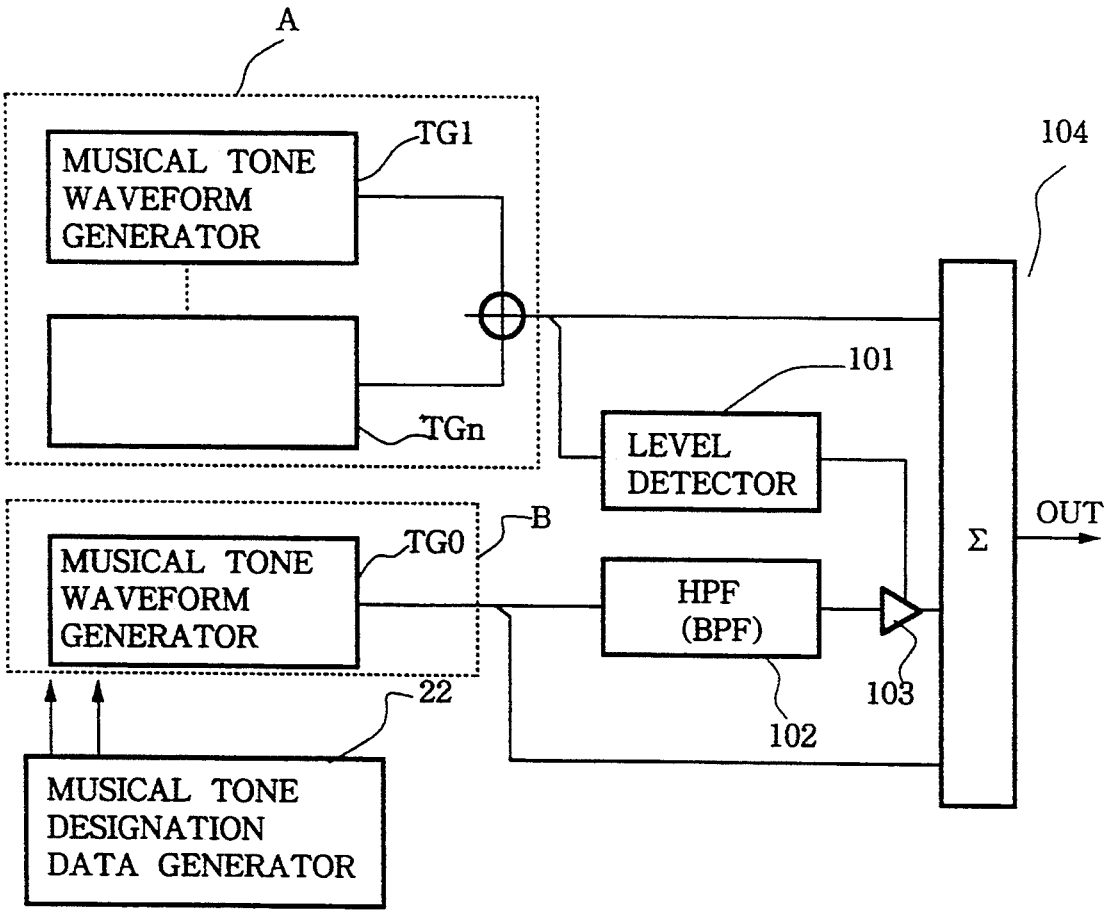
FIG. 10 is a block diagram showing the fifth embodiment of the present invention.

FIG. 10 is a block diagram showing the fifth embodiment of the present invention. This embodiment presents a simplest arrangement comprising a polyphonic system A which has a plurality of musical tone waveform generators TG1 to TGn, and mainly corresponds to accompaniment tones, and a monophonic system B which has a musical tone waveform generator TG0 and corresponds to a solo tone, wherein emphasis of the monophonic system B is controlled in accordance with output levels of the polyphonic system A. In FIG. 10, reference numeral 101 denotes a level detector for detecting an output level of the polyphonic system A obtained by mixing the outputs from the musical tone waveform generators TG1 to TGn; 102, a high-pass filter for allowing only a high-frequency range component of an output from the monophonic system B to pass therethrough; 103, a multiplier for multiplying an output from the level detector 101 with the output from the high-pass filter 102, and outputting a product; and 104, a mixing circuit for mixing outputs from the polyphonic system A, the monophonic system B, and the multiplier 103, and outputting the mixing result. In this arrangement, since the output from the monophonic system B is emphasized and outputted in accordance with an output level of the polyphonic system A, tone color control can be made so that a series tone which corresponds to a solo performance is more stressed in a music piece than the series tones which mainly correspond to an accompaniment, thus adding a desired musical tone effect. In this embodiment, the monophonic system B may also be a polyphonic system, and outputs from both the systems may be emphasized.

Sixth Embodiment

Figure 11:
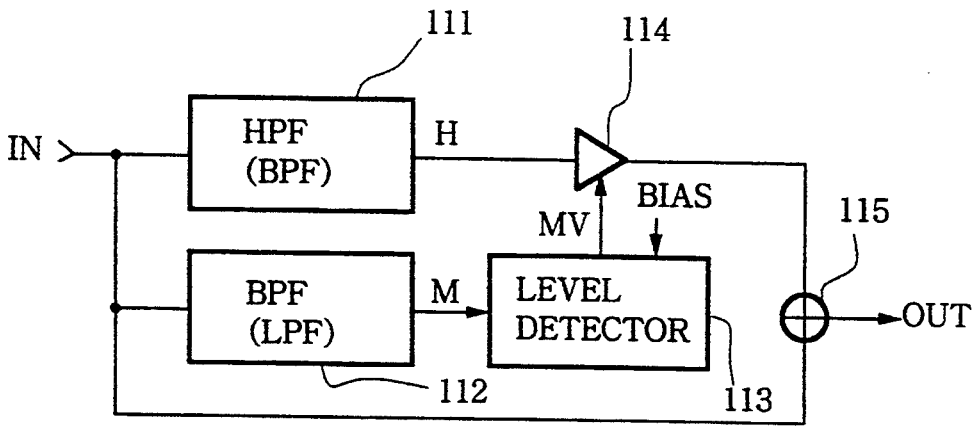
FIG. 11 is a block diagram showing an arrangement of an emphasizer according to the basic sixth embodiment of the present invention.

FIG. 11 is a block diagram showing an arrangement of an emphasizer according to the basic sixth embodiment of the present invention. In FIG. 11, reference numeral 111 denotes a high-pass filter for allowing a high-frequency range component of an input musical tone signal IN to pass therethrough; 112, a band-pass filter for allowing a frequency range lower than that allowed to pass through the filter 111 to pass therethrough; 113, a level detector for detecting a signal level of an output signal M from the filter 112, and outputting the detected signal level; 114, a multiplier means such as a voltage controlled amplifier (for an analog signal) or a multiplier (for a digital signal), for multiplying an output MV from the level detector 113 with an output signal H from the filter 111, and outputting a product; and 115, an adder for adding and mixing an output signal from the multiplier means 114 to the input signal IN, and outputting an output signal OUT. The level detector 113 is applied with a bias voltage BIAS for determining the level of the output MV from the level detector 113 when the output signal M from the filter 112 is 0.

Figure 12:
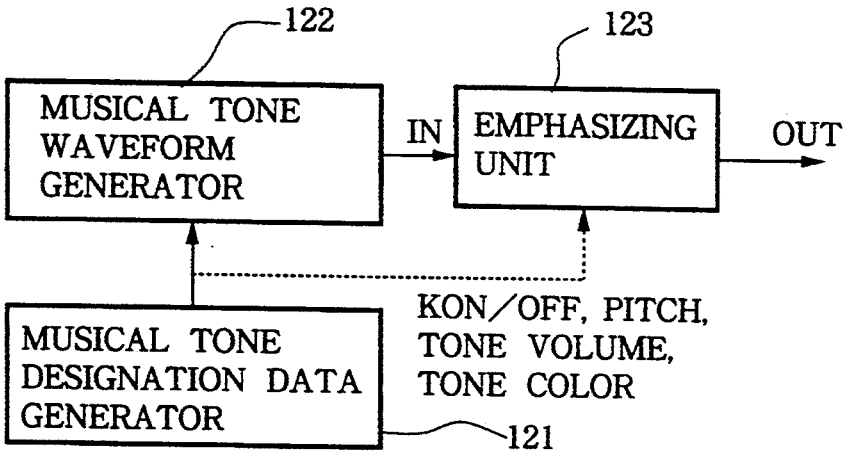
FIG. 12 is a block diagram for exemplifying a basic arrangement of an electronic musical instrument to which the emphasizer of the present invention is applied.

FIG. 12 is a block diagram showing a basic arrangement of an electronic musical instrument to which such an emphasizer is applied. In FIG. 12, reference numeral 121 denotes a musical tone designation data generator for generating musical tone designation data (key ON/-OFF data, pitch data, tone volume data, tone color data, and the like) necessary for generating a basic musical tone signal; 122, a musical tone waveform generator for generating the basic musical tone signal on the basis of the data from the generator 121; and 123, an emphasizing unit for adding some acoustic effects to an output signal from the musical tone waveform generator 122 on the basis of an instruction from the musical tone designation data generator 121 or a predetermined condition, and outputting a processed signal. The emphasizer shown in FIG. 11 is included in the emphasizing unit 123.

When a musical tone signal IN from the musical tone waveform generator 122 is inputted to the emphasizer shown in FIG. 11, a high-frequency range component H, and a lower frequency range component M than the component H are extracted from the signal IN by the high-pass filter 111 and the band-pass filter 112, and a signal level of the lower frequency range component is detected by the level detector 113. The detection signal MV is multiplied with the high-frequency component H by the multiplier means 114. Thus, the high-frequency range component H is emphasized in accordance with the signal level of the lower frequency range component M. The emphasized signal is mixed with the original input musical tone signal IN by the adder 115. Thus, the input signal IN is outputted as a signal in which only the high-frequency range component is emphasized in accordance with the signal level of the lower frequency range component M.

The level detector 113 is applied with the bias voltage BIAS, thereby setting an output signal MV value, i.e., an offset voltage when the input signal M is 0.

Figure 13:
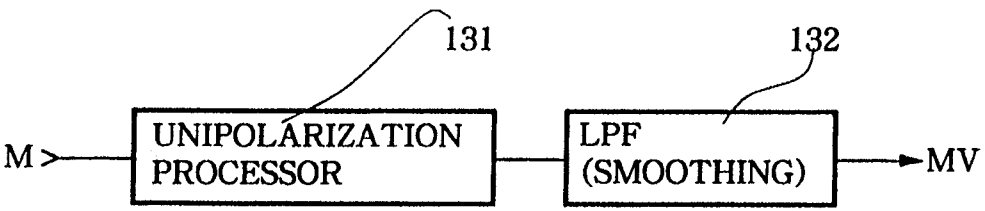
FIG. 13 is a block diagram showing a basic arrangement of a level detector applied to the emphasizer of the present invention.

FIG. 13 is a block diagram showing a basic arrangement of the level detector 113. In FIG. 13, reference numeral 131 denotes a unipolarization processor for unipolarizing the output signal M from the filter 112 (FIG. 11), and outputting a unipolarized output; and 132, a low-pass filter for smoothing the output from the processor 131, and outputting the smoothed signal as the detection signal MV. The level detector 113 basically has a function of unipolarizing (rectifying) the output signal M from the filter 112, and smoothing the unipolarized output using, e.g., the low-pass filter.

As means or methods for processing in the unipolarization processor 131, half-wave rectification, full-wave rectification (absolute value conversion), a square or even number power (2nth power) method, and the like are available.

Figure 14:
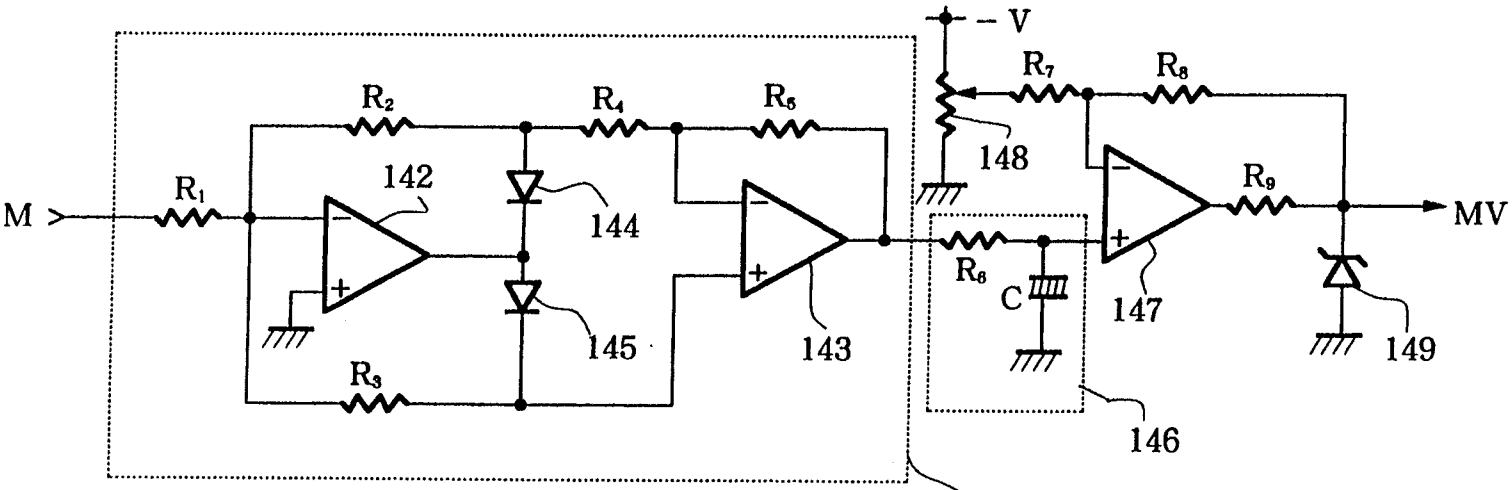
FIG. 14 is a block diagram showing an arrangement of the level detector for an analog signal, which is applicable to the emphasizer of the present invention.

FIG. 14 is a circuit diagram showing an arrangement of the level detector when an analog signal is to be processed. In FIG. 14, reference numeral 141 denotes an absolute value circuit for converting an analog signal M into an absolute value to unipolarize the analog signal. The absolute value circuit 141 comprises operational amplifiers 142 and 143, diodes 144 and 145, and resistors $R_1$ to $R_5$ having the same resistance. Reference numeral 146 denotes a CR primary low-pass filter, comprising a resistor $R_6$ and a capacitor C, for smoothing the absolute value signal outputted from the absolute value circuit 141, and outputting the smoothed signal. Reference numeral 147 denotes an operational amplifier for receiving the smoothed signal outputted from the CR primary low-pass filter 146 at its noninverting input terminal, and amplifying the smoothed signal. The operational amplifier 147 receives, at its inverting input terminal, a DC bias voltage (−V) for adjusting an offset voltage via a variable resistor 148 and a resistor $R_7$. The output terminal of the operational amplifier 147 is grounded through a zener diode 149 serving as an output limiter, so that a maximum value of an output MV is limited in accordance with a zener voltage value of the zener diode 149.

Figure 15:
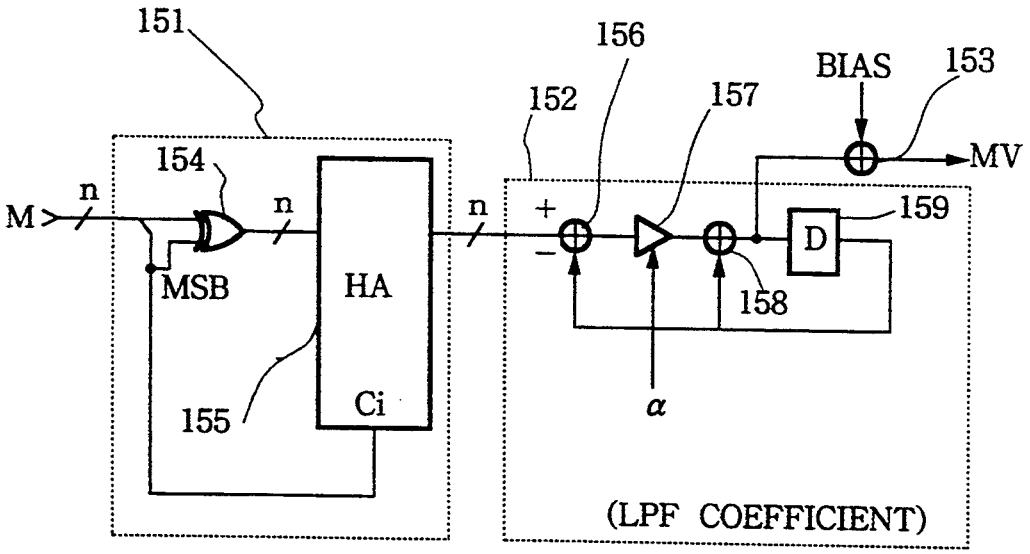
FIG. 15 is a block diagram showing an arrangement of the level detector for a digital signal, which is applicable to the emphasizer of the present invention.

FIG. 15 is a circuit diagram for exemplifying an arrangement of the level detector for a digital signal. In FIG. 15, reference numeral 151 denotes a digital absolute value circuit for converting an n-bit input signal into an absolute value, and outputting the absolute value signal; 152, a primary digital low-pass filter for smoothing the output from the digital absolute value circuit 151, and outputting the smoothed output; and 153, an adder for adding a predetermined bias value to the output from the filter 152, and outputting the sum. The digital absolute value circuit 151 comprises an EX-OR gate 154 for logically EX-ORing the input signal M obtained by expressing a negative value as a complementary number, and its MSB (most significant bit), and outputting an EX-ORed result; and a half adder 155 for adding the MSB to the output from the EX-OR gate 154, and outputting the sum. The circuit 151 judges the polarity (positive or negative) of the input signal M, and converts it into an absolute value. The digital low-pass filter 152 comprises an adder/subtractor 156 for adding an input signal from the digital absolute value circuit 151, subtracting an input signal from a delay circuit 159, and outputting the result, a multiplier 157 for multiplying the output from the adder/subtractor 156 with a coefficient $\alpha$, and outputting the product, an adder 158 for adding an input from the delay circuit 159 to an input from the multiplier 157, and outputting the sum, and the delay circuit 159 for delaying the data inputted from the adder 158 by one period (fundamental period) of a sampling pulse. The filter 152 can vary smoothing characteristics (cutoff frequency) in accordance with the coefficient $\alpha$ inputted to the multiplier 157.

Figure 16A:
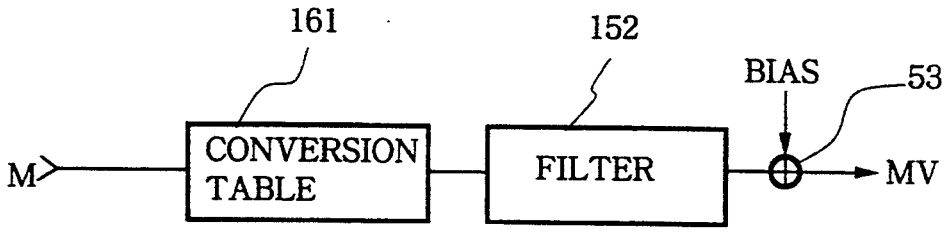
FIGS. 16*a* to 16*c* are a circuit diagram and graphs for explaining a case wherein unipolarization processing in the level detector shown in FIG. 15 is performed by using a conversion table.
Figure 16B:
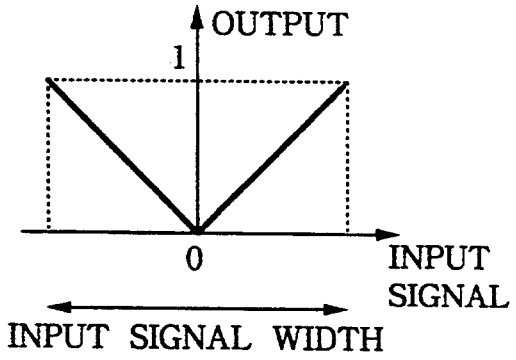
Figure 16C:
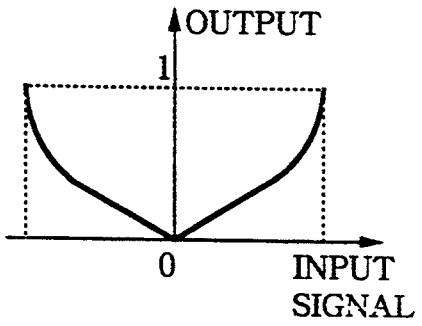

FIG. 16*a* shows an arrangement of the level detector wherein a circuit 161 for performing unipolarization by looking up a conversion table is used in place of the digital absolute value circuit 151 in the level detector shown in FIG. 15. The circuit 161 employs a table having characteristics shown in FIG. 16*b* or 16*c*, and looks up this table using data according to the amplitude of the input signal M as an address to obtain an output, thus performing unipolarization. In particular, when a table having nonlinear characteristics, as shown in FIG. 16*c* is employed, unipolarization with nonlinear characteristics can be advantageously performed by a simple arrangement.

Figure 17:
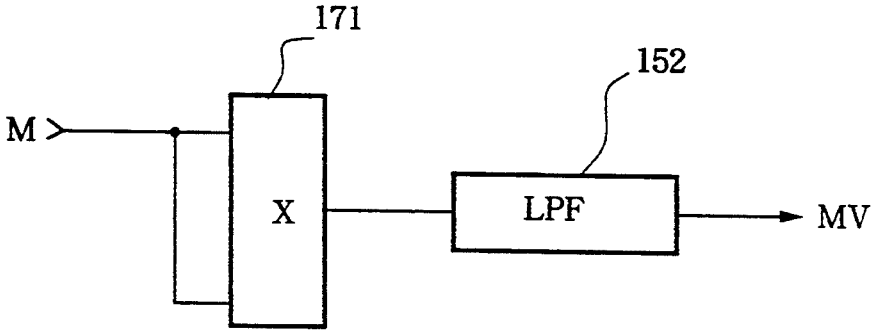
FIGS. 17 and 18 are block diagrams showing arrangements obtained when unipolarization processing in the level detector shown in FIG. 15 is attained by calculating a square or a 2nth power.
Figure 18:
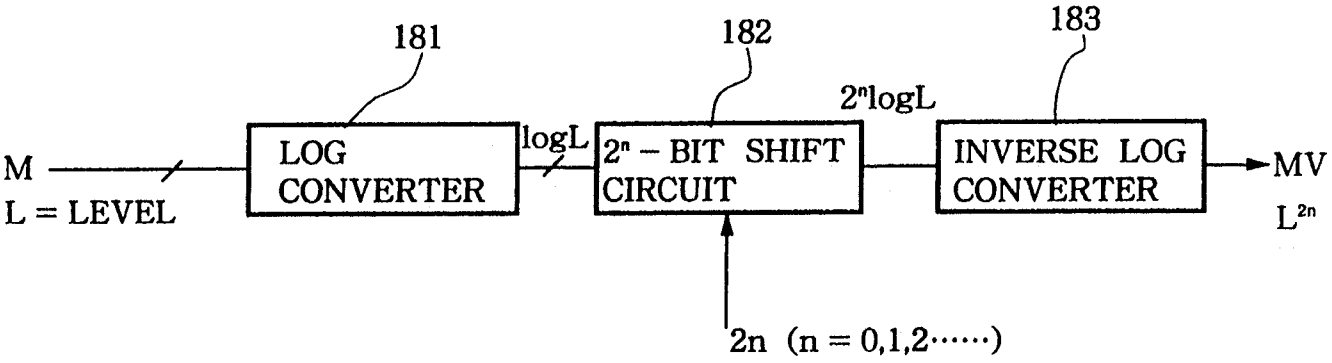

Alternatively, as shown in FIG. 17, an input signal value may be simply squared by a multiplier 171 to attain unipolarization. As an example for attaining unipolarization by calculating a 2nth power, as shown in FIG. 18, after an amplitude L of an input signal is log-converted by a log converter 181, the converted value is $2^n$-bit-shifted by a shift circuit 182, and the shifted value is then inverse-log-converted by an inverse log converter 183. In this method, log conversion and inverse log conversion may be attained by arithmetic operations or by looking up tables.

Seventh Embodiment

Figure 19:
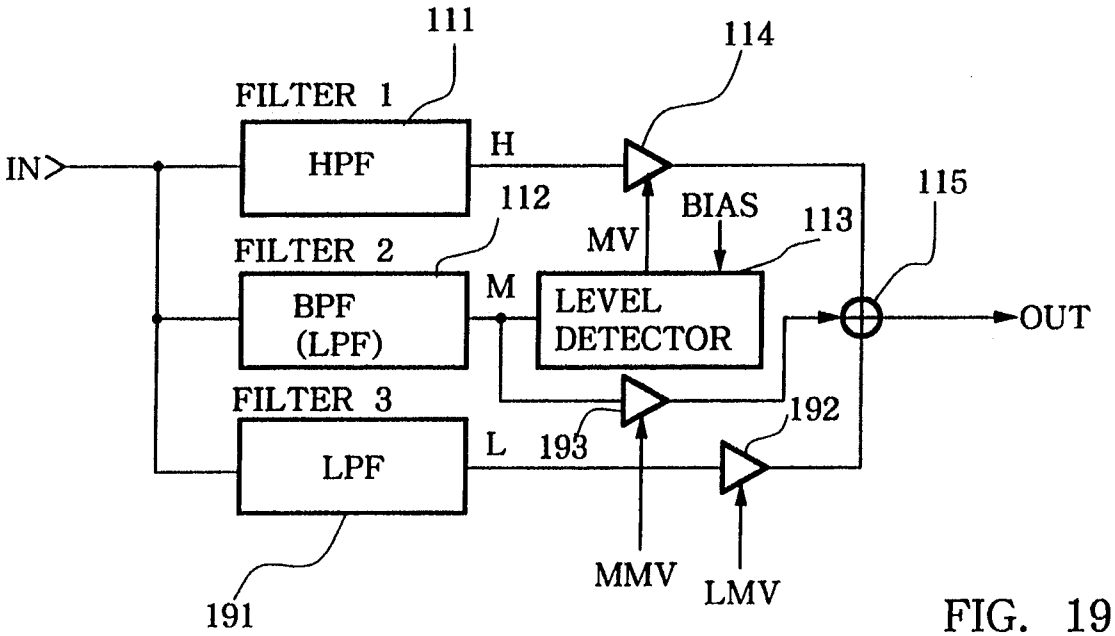
FIGS. 19 to 22 are block diagrams showing arrangements of emphasizers according to other embodiments of the present invention.

FIG. 19 is a block diagram showing an arrangement of an emphasizer according to the basic seventh embodiment of the present invention. The same reference numerals in FIG. 19 denote the same parts as in FIG. 11. Reference numeral 191 denotes a low-pass filter for allowing a low-frequency range component L of an input signal L to pass therethrough; 192, a multiplier means, inserted between the low-pass filter 191 and an adder 115, for multiplying a signal LMV from a low-range mixing volume with an output from the low-pass filter 191; and 193, a multiplier means, inserted between a band-pass filter 112 and the adder 115, for multiplying a signal MMV from a mid-range mixing volume with an output from the band-pass filter 112.

In this embodiment, an input musical tone signal IN is divided into three components, i.e., high-, middle-, and low-frequency range components H, M, and L by the filters 111, 112, and 191. The high-frequency range component H is emphasized in accordance with the level of the middle-frequency range component M as in the first embodiment. The emphasized signal, and the middle- and low-frequency range components whose mixing levels are desirably adjusted via the multiplier means 193 and 192 are mixed by the adder 115, and the mixed signal is outputted. Therefore, emphasis of the high-frequency range component, and equalizing in units of frequency ranges can be attained.

Eighth Embodiment

Figure 20:
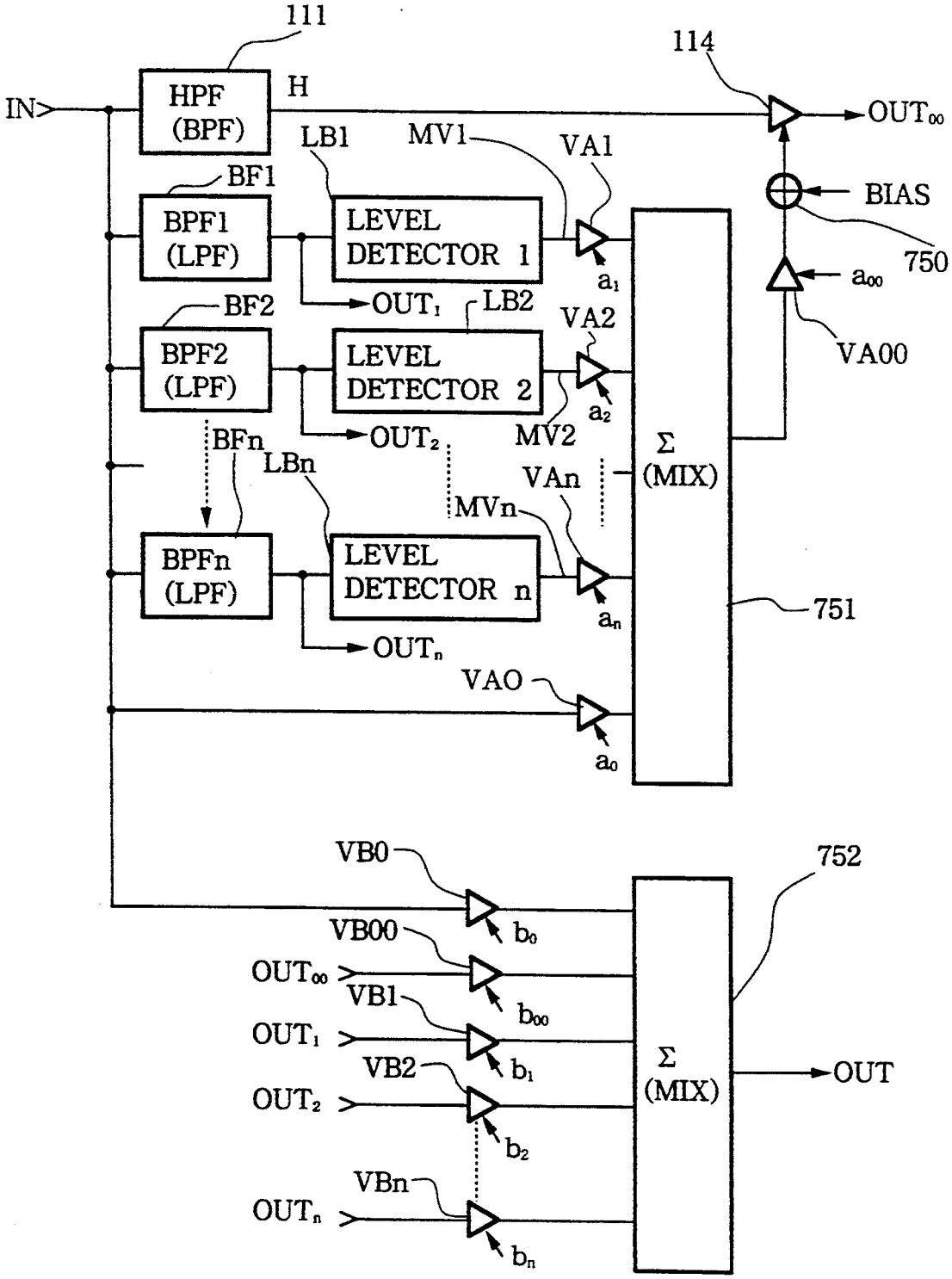

FIG. 20 is a block diagram showing an arrangement of an emphasizer according to the eighth embodiment of the present invention. This embodiment comprises a plurality of band-pass filters BF1 to BFn, and a plurality of level detectors LB1 to LBn, which further divide a middle-frequency range component of an input musical tone signal IN into a plurality of frequency range components OUT1 to OUTn, and detect their signal levels.

The input musical tone signal IN and level detection signals MV1 to MVn of the respective frequency range components are inputted to and mixed by a mixing circuit 751. A high-frequency range component H extracted by a high-pass filter 111 is emphasized via a multiplier 114 in accordance with the signal level of the mixed signal. The emphasized high-frequency range component OUT00, the middle-frequency range components OUT1 to OUTn, and the input musical tone signal IN are inputted to and mixed by a mixing circuit 752, thus obtaining a mixed signal. An adder 750 is inserted between the mixing circuit 751 and the multiplier 114, so that a bias voltage is added to the output from the mixing circuit 751 via the adder 750, thus setting an offset voltage. A mixing volume VA00 is inserted between the mixing circuit 751 and the adder 750, so that the output from the mixing circuit 751 is adjusted in accordance with a control signal $a_{00}$. The input musical tone signal IN and the level detection signals MV1 to MVn are inputted to the mixing circuit 751 via multiplier means VA0 to VAn, respectively, and are subjected to level adjustment in accordance with control signals $a_0$ to $a_n$, respectively. Similarly, the input levels of the emphasized high-frequency range component OUT00, the input musical tone signal IN, and the frequency range components OUT1 to OUTn are adjusted by multiplier means VB00 and VB0 to VBn in accordance with control signals $b_{00}$ and $b_0$ to $b_n$, respectively.

With this arrangement, the high-frequency range component can be emphasized in accordance with level detection results of the respective frequency range components, which results are weighted upon operation of the mixing volume for supplying the control signals $a_{00}$, $a_0$ to $a_n$, $b_{00}$, and $b_0$ to $b_n$ to the multiplier means. At the same time, the emphasized high-frequency range component, and middle-frequency range components are weight-mixed and equalized. Furthermore, if characteristics, e.g., cutoff frequencies, Q values, or the like of the filters 111 and BF1 to BFn can be independently controlled, the degree of freedom and possibility of changes in tone colors can be further extended.

Ninth Embodiment

Figure 21:
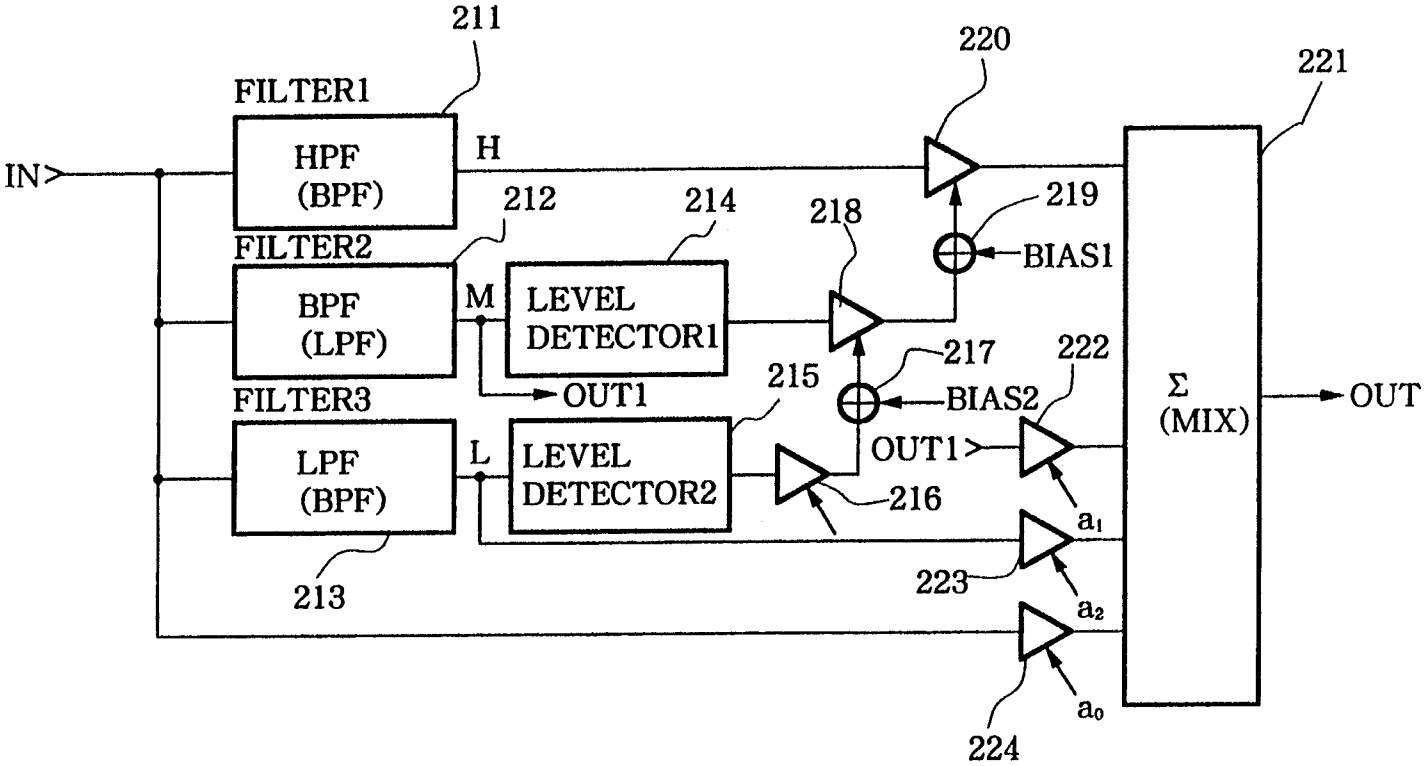

FIG. 21 is a block diagram showing an arrangement of an emphasizer according to the ninth embodiment of the present invention.

In FIG. 21, reference numerals 211 to 213 denote a high-pass filter, a band-pass filter, and a low-pass filter for respectively allowing high-, middle-, and low-frequency range components H, M, and L of an input musical tone signal IN to pass therethrough; 214 and 215, level detectors for respectively detecting output signal levels of the middle- and low-frequency range components outputted from the filters 212 and 213; 216, a multiplier means for adjusting an output level of the level detector 215; 217, an adder for adding a bias voltage BIAS2 as an offset value to an output voltage from the multiplier means 216; 218, a multiplier means for multiplying an output from the level detector 214 and an output from the adder 217, and outputting a product; 219, an adder for adding a bias voltage BIAS1 as an offset value to an output from the multiplier means 118; 220, a multiplier means for multiplying an output from the adder 219 with the high-frequency range component H from the filter 211, and outputting a product; and 221, a mixing circuit for mixing an output from the multiplier means 220, the middle- and low-frequency range components M and L from the filters 212 and 213, and the input musical tone signal IN and outputting the mixed signal. The middle- and low-frequency range components M and L, and the input musical tone signal IN are inputted to the mixing circuit 211 via multiplier means 222 to 224, respectively, and are adjusted in accordance with control signals $a_1$, $a_2$, and $a_0$, respectively.

In this case, a level detection signal of the low-frequency range component L detected by the level detector 215 is multiplied with a level detection signal of the middle-frequency range component M detected by the level detector 214 by the multiplier means 218, and the high-frequency range component H is emphasized in accordance with the product signal. The emphasized high-frequency range component, the middle- and low-frequency range components M and L, and the input musical tone signal IN are mixed and outputted. More specifically, a level detection signal of an output from the higher-order filter 212 is controlled in accordance with a level detection signal of the adjacent lower-order filter 213. This control can be essentially regarded as emphasis control of the high-frequency range component on the basis of the product of the level detection signals of the middle- and low-frequency ranges.

Tenth Embodiment

Figure 22:
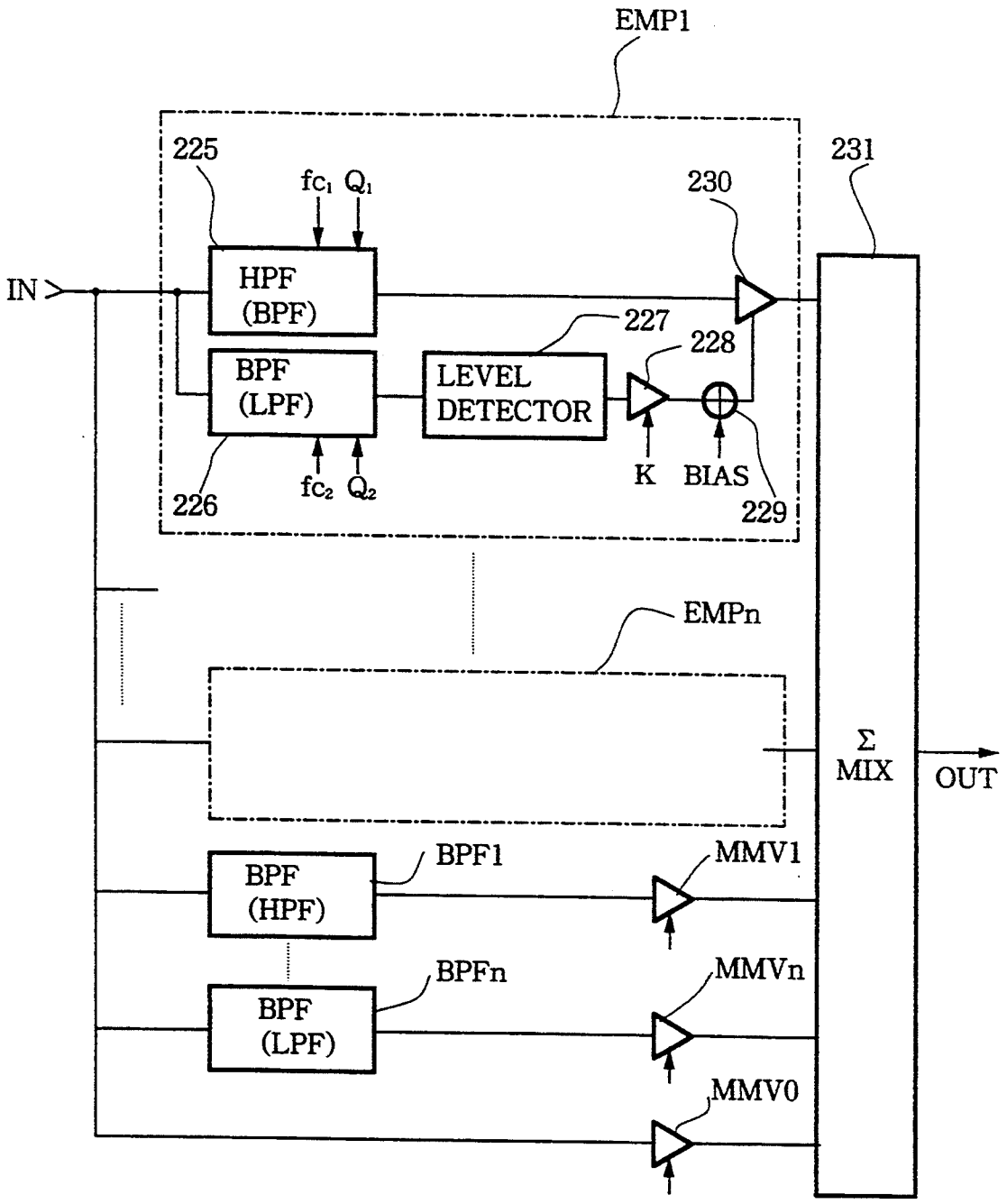

FIG. 22 is a block diagram showing an arrangement of an emphasizer according to the tenth embodiment of the present invention. In FIG. 22, reference symbols EMP1 to EMPn denote basic emphasizers, as shown in FIG. 11, each of which comprises a high-pass filter 225 and a band-pass filter 226 for respectively extracting high- and middle-frequency range components from an input musical tone signal IN, and outputting the extracted components, a level detector 227 for detecting a signal level of the middle-frequency range component from the filter 226, a multiplier means 228 for adjusting an output level of the level detector 226, an adder 229 for adding a bias voltage to an output voltage from the multiplier means 228 to set an offset voltage, and a multiplier means 230 for multiplying an output from the adder 229 and the high-frequency range component from the high-pass filter 225, and outputting a product. Cutoff frequencies and Q values of the filters 225 and 226 can be independently set in accordance with control signals $f_{C1}$, $Q_1$, $f_{C2}$, and $Q_2$, and an output from the level detector 227 can be adjusted via the multiplier means 228 in accordance with a control signal k. Therefore, when the basic emphasizers EMP1 to EMPn have different setting values, emphasis effects can be added in units of preset frequency ranges.

Reference symbols BPF1 to BPFn denote band-pass filters for extracting predetermined frequency range components from the input musical tone signal IN, and outputting the extracted components; and MMV1 to MMVn, multiplier means for adjusting outputs from the filters BPF1 to BPFn, respectively. These filters and multiplier means constitute a simple equalizer.

Reference numeral 231 denotes a mixing circuit for mixing emphasized signals in units of frequency ranges outputted from the emphasizers EMP1 to EMPn, the musical tone signal IN adjustably inputted through the multiplier means MMV0 and MMV1 to MMVn, and signals of respective frequency ranges extracted by the filters BPF1 to BPFn, and outputting a mixed signal.

In each of the above embodiments, filtering processing for an input musical tone signal may be performed by an analog circuit, and level detection may be performed by a digital circuit. That is, an arrangement including both analog and digital processing operations may be adopted.

A large number of various filtering processing operations, arithmetic processing operations, and the like may be time-divisionally performed.

Each filter may comprise a variable filter, so that its frequency range and characteristics can be desirably determined by a user. Alternatively, each filter may be appropriately set in units of tone colors, or may have characteristics which change over time.

In each of the above embodiments, an arrangement having a "one-to-one" correspondence has been mainly exemplified, i.e., a given frequency range is controlled by the signal level of another frequency range. However, a plurality of frequency ranges may be controlled at the same time.

In each of the above embodiments, a high-frequency range component is emphasized in accordance with the levels of middle-frequency range components. In place of the high-pass filter and the band-pass filters, a band-pass filter and low-pass filters may be employed, so that various optimal characteristic relationships may be selected in accordance with characteristics of input musical tone signals to be processed.

As described above, according to the present invention, a predetermined frequency range component of a musical tone signal is emphasized on the basis of the output level of an envelope generator which is normally arranged in an electronic musical instrument. Therefore, various novel effects which cannot be attained by a conventional system can be given to musical tones by a simple arrangement.

Since a second frequency range component is emphasized in accordance with the signal level of a first frequency range component, the first and second frequency ranges can be appropriately selected, so that delicate and colorful output balance control in units of frequency ranges can be performed without impairing an S/N ratio due to amplification of unnecessary components.

For example, a solo part tone in a high-tone range is emphasized in accordance with an envelope signal for an accompaniment tone or a tone volume level in a middle-tone range. Thus, an effect for emphasizing a solo part without deteriorating original tone color balance of original tones, and outputting a clear musical tone signal can be given to an input musical tone signal.

What is claimed is:

1. An emphasize system for an electronic musical instrument, comprising:

an envelope generator for generating an envelope signal for an input musical tone signal in accordance with the input musical tone signal;

a control signal generator for producing a control signal based upon the envelope signal;

filter means for allowing a predetermined frequency range component of the input musical tone signal to pass therethrough;

multiplier means for multiplying a signal passing through said filter means and the control signal and outputting a product signal; and mixing means for mixing said product signal and the input musical tone signal, and outputting a mixed signal;

wherein the control signal is obtained by squaring the envelope signal.

2. An emphasize system for an electronic musical instrument, comprising:

an envelope generator for generating an envelope signal for an input musical tone signal in accordance with the input musical tone signal;

filter means for allowing a predetermined frequency range component of the input musical tone signal to pass therethrough;

multiplier means for multiplying a signal passing through said filter means and a control signal based on the envelope signal from the envelope generator and outputting a product signal;

mixing means for mixing said product signal and the input musical tone signal, and outputting a mixed signal, wherein the control signal is obtained by log-converting the envelope signal.

3. An emphasize system for an electronic musical instrument, comprising:

an envelope generator for generating an envelope signal for an input musical tone signal in accordance with the input musical tone signal;

filter means for allowing a predetermined frequency range component of the input musical tone signal to pass therethrough;

multiplier means for multiplying a signal passing through said filter means and a control signal based on the envelope signal from the envelope generator and outputting a product signal;

mixing means for mixing said product signal and the input musical tone signal, and outputting a mixed signal, wherein the control signal is obtained in such a manner that the envelope signal is compared with a predetermined signal, and the envelope signal is subjected to predetermined processing in accordance with the comparison result.

4. An emphasize system for an electronic musical instrument, comprising:

a plurality of envelope generators for generating a plurality of envelope signals;

a plurality of musical tone generators for generating a plurality of musical tone signals;

filter means for emphasizing a predetermined frequency range component on an input musical tone signal obtained by mixing signals from the plurality of musical tone generators;

multiplier means for multiplying a signal passing through the filter means and a control signal based on one of the envelope signals which satisfies a predetermined condition, and outputting a product signal; and mixing means for mixing the product signal and the input musical tone signal and outputting a mixed signal;

wherein the envelope signal which satisfies the predetermined condition is an envelope signal from an envelope generator corresponding to a key having a maximum key touch at the electronic musical instrument.

5. An emphasize system for an electronic musical instrument, comprising:

an envelope generator for generating an envelope signal for an input musical tone signal in accordance with the input musical tone signal;

filter means for allowing a predetermined frequency range component of the input musical tone signal to pass therethrough;

multiplier means for multiplying a signal passing through said filter means and a control signal based on the envelope signal from the envelope generator and outputting a product signal;

mixing means for mixing said product signal and the input musical tone signal, and outputting a mixed signal, wherein said filter means includes a plurality of filters having different pass ranges, and the control signal is subjected to predetermined processing on the basis of a comparison result of outputs from said plurality of filters.

6. An emphasize system for an electronic musical instrument, comprising:

an envelope generator for generating an envelope signal for an input musical tone signal in accordance with the input musical tone signal;

a control signal generator for producing a control signal based upon the envelope signal;

filter means for allowing a predetermined frequency range component of the input musical tone signal to pass therethrough;

multiplier means for multiplying a signal passing through said filter means and the control signal and outputting a product signal; and mixing means for mixing said product signal and the input musical tone signal, and outputting a mixed signal;

wherein said emphasize system is arranged in correspondence with each of a plurality of systems of musical tone generators of said electronic musical instrument;

the outputs from said emphasize systems are mixed; and the control signal is supplied only to an emphasize system connected to a musical tone generator in which an output level of the envelope generator is above a predetermined amount.

7. An emphasize system for an electronic musical instrument, the electronic musical instrument including a plurality of musical tone generators for generating a plurality of musical tone signals, comprising:

first signal input means for inputting a first signal produced on the basis of at least one first predetermined musical tone signal from the plurality of musical tone signals;

second signal input means for inputting a second signal produced in accordance with at least one second predetermined musical tone signal from the plurality of musical tone signals;

level detection means for detecting a level of the first signal;

multiplier means for multiplying an output signal from said level detection means with the second signal and outputting a product signal; and mixing means for mixing the product signal and the first and second musical tone signals, and outputting a mixed signal.

8. An emphasize system for an electronic musical instrument, comprising:

first filter means for extracting and outputting a first frequency range component of an input musical tone signal;

second filter means for extracting and outputting a second frequency range component of the input musical tone signal, the second frequency range being different from the first frequency range;

level detection means for detecting and outputting an output signal level of said second filter means;

multiplier means for multiplying a signal based on an output from said level detection means with an output signal from said first filter means, and outputting a product signal; and mixing means for mixing said product signal with a musical tone signal based on the input musical tone signal, and outputting a mixed signal.

9. A system according to claim 8, wherein said level detection means is applied with a bias voltage for setting an output signal value when a signal level inputted thereto is zero.

10. A system according to claim 8, wherein said level detection means comprises means for rectifying an input signal and outputting a rectified signal, and means for smoothing an output from said rectifying means, and outputting a smoothed output.

11. A system according to claim 8, wherein cutoff frequencies and Q values of said first and second filter means are adjustable.

12. A system according to claim 11, wherein a plurality of said emphasize systems are connected in parallel with each other.

13. A system according to claim 8, further including a plurality of sets of said second filter means and said level detection means.

14. A system according to claim 8, wherein the musical tone signal based on the input musical tone signal is an output signal from said second filter means.

15. A system according to claim 8, further comprising third filter means for extracting and outputting a third frequency range component of the input musical tone signal, and second level detection means for detecting and outputting an output signal level of said third filter means, and wherein the output signal from said level detection means is controlled in accordance with a signal based on an output from said second level detection means.

16. A system according to claim 8, further comprising means for adjusting levels of the output signal from said level detection means and the musical tone signal based on the input musical tone signal.

17. An emphasize system for an electronic musical instrument, comprising:

first filter means for extracting and outputting a first frequency range component of an input musical tone signal;

second filter means for extracting and outputting a second frequency range component of the input musical tone signal, the second frequency range being different from the first frequency range;

level detection means for detecting and outputting an output signal level of said second filter means; and control means for controlling the level of an output signal from said first filter means on the basis of an output signal from said level detection means.

18. A system according to claim 17, further comprising mixing means for mixing the signal the level of which is controlled by said control means with the input musical tone signal.

19. A system according to claim 17, further comprising mixing means for mixing the signal the level of which is controlled by said control means with the output from said second filter means.

20. An emphasize system for an electronic musical instrument, comprising:

first filter means for extracting and outputting a first frequency range component of an input musical tone signal;

second filter means for extracting and outputting a second frequency range component of the input musical tone signal;

third filter means for extracting and outputting a third frequency range component of the input musical tone signal;

first level detection means for detecting and outputting an output signal level of said second filter means;

second level detection means for detecting and outputting an output signal level of said third filter means;

modifying means for modifying an output signal from said first level detection means on the basis of an output signal from said second level detection means; and control means for controlling the level of an output signal from said first filter means on the basis of the output signal modified by said modifying means.

21. A system according to claim 20, further comprising mixing means for mixing the signal the level of which is controlled by said control means with the output signals from said second and third filter means.

22. A system according to claim 21, wherein the input musical tone signal is mixed with the signal the level of which is controlled by the control means and with the output signals from the second and third filter means.

23. An emphasize system for an electronic musical instrument, comprising:

first filter means for extracting and outputting a first frequency range component of an input musical tone signal;

second filter means for extracting and outputting a second frequency range component of the input musical tone signal, the second frequency range being different from the first frequency range;

third filter means for extracting and outputting a third frequency range component of the input musical tone signal;

first level detection means for detecting and outputting an output signal level of said second filter means;

second level detection means for detecting and outputting an output signal level of said third filter means; and control means for controlling the level of an output signal from said first filter means on the basis of output signals from said first and second level detection means.

24. A system according to claim 23, wherein output signals from said first and second level detection means are weighted respectively and added, and said control means controls the level of an output signal from said first filter means on the basis of an weighted and added signal.

25. A system according to claim 23, further comprising mixing means for mixing the signal the level of which is controlled by said control means with the output signals from said second and third filter means.

26. A system according to claim 25, wherein the input musical tone signal is further mixed by said mixing means.

27. An emphasize system for an electronic musical instrument, comprising:

first filter means for extracting and outputting a first frequency range component of an input musical tone signal;

second filter means for extracting and outputting a second frequency range component of the input musical tone signal, the second frequency range being different from the first frequency range;

third filter means for extracting and outputting a third frequency range component of the input musical tone signal;

fourth filter means for extracting and outputting a fourth frequency range component of the input musical tone signal;

first level detection means for detecting and outputting an output signal level of said second filter means;

second level detection means for detecting and outputting an output signal level of said fourth filter means;

first control means for controlling the level of an output signal from said first filter means on the basis of an output signal from said first level detection means;

second control means for controlling the level of an output signal from said third filter means on the basis of an output signal from said second level detection means; and mixing means for mixing the signal the level of which is controlled by said first control means and the signal the level of which is controlled by said second control means.

28. A system according to claim 27, wherein the input musical tone signal is mixed with the signal the level of which is controlled by said first control means and the signal the level of which is controlled by said second control means.

29. A system according to claim 27, further comprising fifth filter means for extracting and outputting a fifth frequency range component of the input musical tone signal, and an output signal from said fifth filter means being further mixed by said mixing means.

30. A system according to claim 29, wherein the input musical tone signal is further mixed by said mixing means.

31. An emphasize system for an electronic musical instrument, comprising:

envelope generating means for generating an envelope signal;

musical tone signal generation means for generating a musical tone signal, the level of which is controlled on the basis of said envelope signal;

filter means for allowing a frequency range component of said musical tone signal to pass therethrough; and control means for controlling the level of said musical tone signal passing through said filter means on the basis of said envelope signal;

wherein said control means converts said envelope signal into an appropriate coefficient by use of a conversion table, and controls the level of the output signal from said filter means by multiplying it with said coefficient.

32. An emphasize system for an electronic musical instrument, comprising:

a plurality of musical tone signal generation means each for generating a musical tone signal and each including an envelope generating means for generating an envelope signal, wherein the level of said musical tone signal is controlled on the basis of said envelope signal, said plurality of musical tone signal generation means generate musical tone signals and envelope signals respectively;

filter means for allowing a frequency range component of a musical tone signal to pass therethrough wherein at least one of said musical tone signals is input to said filter means;

selection means for selecting an envelope signal, from said envelope signals;

control means for controlling the level of said musical tone signal passing through said filter means on the basis of the envelope signal selected by said selection means; and mixing means for mixing said signal the level of which is controlled by said control means with the musical tone signals generated by said musical tone signal generation means.

33. A system according to claim 32, wherein said musical tone signals are all mixed and inputted to said filter means.

34. A system according to claim 32, wherein said selection means compares the levels of said envelope signals, and selects an envelope signal having the highest level.

35. A system according to claim 32, further comprising performance operation means for generating a performance signal representing performance state whereby said selection means selects said envelope signal on the basis of said performance signal.

36. A system according to claim 35, wherein said performance operation means comprise the keys of a keyboard, and said performance signal includes a touch signal indicating force or speed or depression of the keys, whereby said selection means selects an envelope signal generated on the basis of a touch signal indicating the strongest force or the highest speed of depression.

37. An emphasize system for an electronic musical instrument, comprising:

envelope generating means for generating an envelope signal;

musical tone signal generation means for generating musical tone signal, the level of which is controlled on the basis of said envelope signal;

first filter means for extracting and outputting a first frequency range component of said musical tone signal;

second filter means for extracting and outputting a second frequency range components of said musical tone signal;

level detection means for outputting a level signal at least on the basis of an output signal level of said second filter means;

arithmetic means for outputting a level control signal on the basis of a predetermined arithmetic of said level signal and said envelope signal;

control means for controlling the level of an output signal from said first filter means on the basis of an output from said arithmetic means and outputting a level controlled signal; and mixing means for mixing the signal the level of which is controlled by said control means with the input musical tone signal.

38. A system according to claim 37, wherein said level detection means outputs said level signal on the basis of a result of comparing the output signal levels of said first and second filter means.

39. An emphasize system for an electronic musical instrument, comprising:

a plurality of musical tone signal generation means each for generating a musical tone signal and each including an envelope generating means for generating an envelope signal, wherein the level of said musical tone signal is controlled on the basis of said envelope signal, said plurality of musical tone signal generation means generate musical tone signals and envelope signals respectively;

first filter means for extracting and outputting a first frequency range component of an input musical tone signal;

second filter means for extracting and outputting a second frequency range component of the input musical tone signal, wherein at least one of said musical tone signals are input to said first and second filter means;

level detection means for outputting a level signal at least on the basis of an output signal level of said second filter means;

selection means for selecting one of the envelope signals;

arithmetic means for outputting a level control signal on the basis of a predetermined arithmetic of said level signal and said envelope signal selected by said selection means; and control means for controlling the level of an output signal from said first filter means on the basis of said level control signal.

40. A system according to claim 39, wherein all of said musical tone signals generated from said musical tone signal generation means are respectively inputted to said first and second filter means, further comprising mixing means for mixing the signal the level of which is controlled by said control means with all of said musical tone signals.

41. An emphasize system for an electronic musical instrument comprising:

a plurality of emphasize units corresponding respectively to a plurality of musical tone signal generation means of the electronic musical instrument, each musical tone signal generation means generating a musical tone signal and each including envelope generating means for generating an envelope signal, the level of the musical tone signal being controlled on the basis of said envelope signal, said plurality of musical tone signal generation means generating musical tone signals and envelope signals, each unit comprising filter means for extracting and outputting a frequency range component of one of said musical tone signals from the corresponding musical tone signal generation means, level control means for controlling the level of an output signal from the filter means on the basis of one of said envelope signals from the corresponding musical tone signal generation means, and first mixing means for mixing the signal the level of which is controlled by said control means with said musical tone signal from corresponding musical tone signal generation means and outputting a mixed signal;

envelope signal selection means for selecting at least one of envelope signals so that only the level control means corresponding to the selected envelope signal or signals are activated; and second mixing means for mixing said mixed signals from the emphasize units.

42. A system according to claim 41, wherein said envelope signal selection means comprises a plurality of AND gates, and selects and outputs an envelope signal having the highest level.

43. An emphasize system for an electronic musical instrument, comprising:

a plurality of musical tone generation means for generating musical tone signals;

filter means for extracting and outputting a frequency range component of an input musical tone signal wherein at least one of musical tone signals is input to said filter means;

volume signal generation means for generating volume signals representing the levels of musical tone signals other than the musical tone signals input to the filter means;

level control means for controlling the level of an output signal from said filter means on the basis of at least one of the volume signals; and mixing means for mixing the signal the level of which is controlled by said level control means with the musical tone signals from all musical tone signal generation means.

44. A system according to claim 43, wherein the volume signal generation means comprises level detection means for detecting said levels and outputting the detecting results as said volume signals.

45. A system according to claim 43, wherein each of said plurality of musical tone signal generation means includes envelope generating means for generating an envelope signal, the level of each of said musical tone signals is controlled on the basis of said envelope signal, said level control means controls the level of said output signal from said filter means on the basis of at least one of said envelope signals as said at least one of volume signals.

46. An emphasize system for an electronic musical instrument, comprising:

musical tone waveform generation means for generating a musical tone waveform signal;

filter means for allowing a frequency range component of said musical tone waveform signal to pass therethrough;

an envelope generating means for outputting an envelope signal in accordance with said musical tone waveform signal for controlling the output level of said filter means;

first level control means for controlling the level of said musical tone waveform signal passing through said filter on the basis of said envelope signal;

mixing means for mixing a signal the level of which is controlled by said first control means with said musical tone waveform signal from said musical tone waveform generation means, and outputting a mixed signal; and second level control means for controlling the level of said musical tone waveform signal from said musical tone waveform generation means on the basis of said envelope signal, wherein the signal the level of which is controlled by said second level control means is input to said filter means.

47. An emphasize system for an electronic musical instrument, comprising:

musical tone waveform generation means for generating a musical tone waveform signal;

filter means for allowing a frequency range component of said musical tone waveform signal to pass therethrough;

an envelope generating means for outputting an envelope signal in accordance with said musical tone waveform signal for controlling the output level of said filter means;

mixing means for mixing signal the level of which is controlled by said first control means with said musical tone waveform signal from said musical tone waveform generation means, and outputting a mixed signal, further comprising second level control means for controlling the level of said mixed signal mixed by said mixing means on the basis of said envelope signal.

48. A method of emphasizing a musical tone signal in an electronic musical instrument, comprising:

extracting a first frequency range component of said musical tone signal;

extracting a second frequency range component of said musical tone signal;

detecting the level of said second frequency range component; and controlling the level of said first frequency range component on the basis of said level of said second frequency range component;

mixing at least the thus level controlled signal and said musical tone signal.

49. A method of emphasizing a musical tone signal in an electronic musical instrument, comprising:

extracting a first frequency range component of said musical tone signal;

extracting a second frequency range component of said musical tone signal;

detecting the level of said second frequency range component; and controlling the level of said first frequency range component on the basis of said level of said second frequency range component.

50. A method of emphasizing musical tone signals in an electronic musical instrument having a plurality of musical tone signal generation means each for generating one of said musical tone signals and each including envelope generating means for generating an envelope signal controlling the level of said one of the musical tone signals, comprising:

extracting a frequency range component of at least one of said musical tone signals;

selecting one of the envelope signals of the envelope generating means;

controlling the level of said frequency range component on the basis of the selected envelope signal; and mixing the thus controlled frequency range component with the musical tone signals generated by said musical tone signal generation means, wherein said one of the envelope signals is selected by comparing the levels of said envelope signals and selecting an envelope signal having the highest level.

51. A method of emphasizing a musical tone signal in an electronic musical instrument having musical tone signal generation means for generating said musical tone signal and envelope generating an envelope signal controlling the level of said musical tone signal, comprising:

extracting a first frequency range component of said musical tone signal;

extracting a second frequency range component of said musical tone signal;

generating a level signal at least on the basis of the signal level of said second frequency range component;

generating a level control signal on the basis of said envelope signal and said level signal;

controlling the level of said first frequency range component on the basis of said level control signal; and mixing the thus controlled first frequency range component with said musical tone signal.

52. A method of emphasizing musical tone signals in an electronic musical instrument having a plurality of musical tone signal generation means each for generating one of said musical tone signals and each including envelope generating means for generating an envelope signal controlling the level of said one of the musical tone signals, comprising:

extracting a first frequency range component of at least one of said musical tone signals;

extracting, from the at least one musical tone signal, a second frequency range component;

generating a level signal at least on the basis of the signal level of said second frequency range component;

selecting one of the envelope signals of the envelope generating means;

generating a level control signal on the basis of the selected envelope signal and said level signal; and controlling the level of said first frequency range component on the basis of said level control signal.

53. A method of emphasizing musical tone signals in an electronic musical instrument having a plurality of musical tone signal generation means each for generating one of said musical tone signals and each including corresponding envelope generating means for generating an envelope signal controlling the level of said one of the musical tone signals, comprising:

extracting frequency range components from said musical tone signals;

controlling the level of at least one of the extracted frequency range components on the basis of at least one of said envelope signals corresponding to said at least one of the components;

mixing each musical tone signal with the thus level controlled or not controlled component thereof; and mixing the thus mixed signal.

54. A method according to claim 53, wherein said at least one of envelope signals is an envelope signal having the highest level.

55. A method of emphasizing musical tone signals in an electronic musical instrument having a plurality of musical tone signal generation means for generating said musical tone signals, comprising:

extracting a frequency range component from one of said musical tone signals;

controlling a level of said frequency range component on the basis of at least one volume signal representing at least one level of a musical tone signal different from said one musical tone signal; and mixing the thus level controlled frequency range component with musical tone signals different from said one musical tone signal.

56. A method of emphasizing a musical tone waveform signal generated by a musical tone waveform generation means in an electronic musical instrument, the level of the musical tone waveform signal being controlled on the basis of an envelope signal, comprising:

extracting a frequency range component from said musical tone waveform signal;

controlling the level of said frequency range component on the basis of said envelope signal; and mixing the thus level controlled component with said musical tone waveform signal;

wherein the level of said musical tone waveform signal is controlled on the basis of said envelope signal before extracting said component.

57. A method of emphasizing a musical tone waveform signal generated by a musical tone waveform generation means in an electronic musical instrument, the level of the musical tone waveform signal being controlled on the basis of an envelope signal, comprising:

extracting a frequency range component from said musical tone waveform signal;

controlling the level of said frequency range component on the basis of said envelope signal; and mixing the thus level controlled component with said musical tone waveform signal;

wherein the level of the mixed signal is further controlled on the basis of said envelope signal.

58. An emphasize system for an electronic musical instrument, comprising:

a plurality of musical tone generators for generating a plurality of musical tone signals;

a plurality of envelope generators, each generating an envelope signal representing the level of one of the plurality of musical tone signals;

filter means for emphasizing a predetermined frequency range component of an input musical tone signal obtained by mixing signals from the plurality of musical tone generators;

multiplier means for multiplying a signal passing through the filter means and a control signal based on one of the envelope signals which satisfies a predetermined condition, and outputting a product signal; and mixing means for mixing the product signal and the input musical tone signal and outputting a mixed signal.

59. A method of emphasizing musical tone signals in an electronic musical instrument having a plurality of musical tone signal generation means each for generating a musical tone signal and each including envelope generating means for generating an envelope signal for controlling the level of one of the musical tone signals, the method comprising the steps of:

mixing all of the musical tone signals to produce a first mixed signal;

extracting first and second frequency range components from the mixed signal;

generating a level signal on the basis of at least a signal level of the second frequency range component;

selecting one of the envelope signals;

generating a level control signal in accordance with the selected envelope signal and the level signal;

controlling the level of the first frequency range component on the basis of the level control signal to produce a level controlled first frequency range component; and mixing the level controlled first frequency range component with the musical tone signals to produce a second mixed signal.

60. A method of emphasizing musical tone signals in an electronic musical instrument having a plurality of musical tone signal generation means for generating the musical tone signals, the method comprising the steps of:

extracting a frequency range component from one of the musical tone signals;

detecting the levels of the musical tone signals from which the frequency range component was not extracted;

outputting the results of the detecting steps as volume signals;

controlling the level of the extracted frequency range component on the basis of at least one of the volume signals; and mixing the level controlled component with the musical tone signals from which the frequency range was not extracted.

61. A method according to claim 60, wherein each of said plurality of musical tone signal generation means includes envelope generating means for generating an envelope signal, the level of each of said musical tone signals is controlled on the basis of said envelope signal, in said controlling step, the level of said frequency range component is controlled on the basis of at least one of said envelope signals as said at least one of volume signals.

* * * * *